US012318666B2

(12) United States Patent
Kuwahara et al.

(10) Patent No.: US 12,318,666 B2
(45) Date of Patent: Jun. 3, 2025

(54) MULTI-PIECE SOLID GOLF BALL

(71) Applicant: BRIDGESTONE SPORTS CO., LTD., Tokyo (JP)

(72) Inventors: Masanobu Kuwahara, Saitamaken (JP); Hideo Watanabe, Saitamaken (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 18 days.

(21) Appl. No.: 18/512,991

(22) Filed: Nov. 17, 2023

(65) Prior Publication Data

US 2024/0173596 A1 May 30, 2024

(30) Foreign Application Priority Data

Nov. 30, 2022 (JP) ..... 2022-190894

(51) Int. Cl.
*A63B 37/06* (2006.01)
*A63B 37/00* (2006.01)

(52) U.S. Cl.
CPC ..... *A63B 37/0075* (2013.01); *A63B 37/0021* (2013.01); *A63B 37/0063* (2013.01); *A63B 37/0084* (2013.01); *A63B 37/0087* (2013.01); *A63B 37/009* (2013.01); *A63B 37/00922* (2020.08); *A63B 37/0096* (2013.01)

(58) Field of Classification Search
CPC ..... A63B 37/0075; A63B 37/00922; A63B 37/0063; A63B 37/009
See application file for complete search history.

(56) References Cited

U.S. PATENT DOCUMENTS

2008/0176676 A1* 7/2008 Watanabe ..... A63B 37/0062 473/376
2011/0250987 A1 10/2011 Umezawa et al.
2011/0250988 A1 10/2011 Umezawa et al.
2011/0250989 A1 10/2011 Umezawa et al.
2011/0287862 A1 11/2011 Higuchi et al.
(Continued)

FOREIGN PATENT DOCUMENTS

JP 2011-218160 A 11/2011
JP 2011-218161 A 11/2011
(Continued)

*Primary Examiner* — Raeann Gorden
(74) *Attorney, Agent, or Firm* — Sughrue Mion, PLLC

(57) ABSTRACT

In a golf ball including a core, an intermediate layer, and a cover, the relationship of the surface hardness between an intermediate layer-encased sphere and the ball satisfies a predetermined relational expression, and with an initial velocity of the ball and a deflection under a predetermined load applied to the ball optimized, and letting a value of (initial velocity of core×weight of core) be Ciw, a value of [(initial velocity of intermediate layer-encased sphere−initial velocity of core)×(weight of intermediate layer-encased sphere−weight of core)] be Miw, and a value of [(initial velocity of ball−initial velocity of intermediate layer-encased sphere)×(weight of ball−weight of intermediate layer-encased sphere)] be CViw, the expression of Ciw+Miw+CViw is optimized, and lift and drag coefficients at predetermined Reynolds numbers and spin rates of dimples are set to predetermined ranges.

12 Claims, 7 Drawing Sheets

(56) References Cited

U.S. PATENT DOCUMENTS

| | | | | |
|---|---|---|---|---|
| 2011/0287863 | A1 | 11/2011 | Higuchi et al. | |
| 2011/0287864 | A1 | 11/2011 | Umezawa et al. | |
| 2011/0287867 | A1 | 11/2011 | Higuchi et al. | |
| 2011/0287868 | A1 | 11/2011 | Umezawa et al. | |
| 2011/0287869 | A1 | 11/2011 | Umezawa et al. | |
| 2012/0277020 | A1 | 11/2012 | Higuchi et al. | |
| 2013/0095955 | A1 | 4/2013 | Higuchi et al. | |
| 2013/0172106 | A1 | 7/2013 | Shinohara | |
| 2013/0172107 | A1 | 7/2013 | Higuchi et al. | |
| 2013/0172108 | A1 | 7/2013 | Higuchi et al. | |
| 2024/0299811 | A1* | 9/2024 | Watanabe ..... | A63B 37/0076 |
| 2025/0010143 | A1* | 1/2025 | Watanabe ..... | A63B 37/0075 |

FOREIGN PATENT DOCUMENTS

| | | | |
|---|---|---|---|
| JP | 2011-218162 | A | 11/2011 |
| JP | 2011-240122 | A | 12/2011 |
| JP | 2011-240123 | A | 12/2011 |
| JP | 2011-240124 | A | 12/2011 |
| JP | 2011-240125 | A | 12/2011 |
| JP | 2011-240126 | A | 12/2011 |
| JP | 2011-240127 | A | 12/2011 |
| JP | 2012-228470 | A | 11/2012 |
| JP | 2013-138839 | A | 7/2013 |
| JP | 2013-138840 | A | 7/2013 |
| JP | 2013-138857 | A | 7/2013 |
| JP | 2014-69045 | A | 4/2014 |

* cited by examiner

MULTI-PIECE SOLID GOLF BALL

CROSS-REFERENCE TO RELATED APPLICATIONS

This non-provisional application claims priority under 35 U.S.C. § 119(a) on Patent Application No. 2022-190894 filed in Japan on Nov. 30, 2022, the entire contents of which are hereby incorporated by reference.

TECHNICAL FIELD

The present invention relates to a multi-piece solid golf ball including a core, an intermediate layer, and a cover, wherein a large number of dimples are formed on an outer surface of the cover.

BACKGROUND ART

In March 2022, manufacturers of golf balls were notified by the Royal and Ancient Golf Club of St Andrews (hereinafter, R&A) and the United States Golf Association (herein after, USGA) that they would start research to suppress the distance by long hitters by changing test conditions for the Overall Distance Standard (hereinafter, ODS) of golf balls in the future. For this reason, it is preferable to provide a golf ball that does not simply reduce distance, but while making the distance for reducing the distance on shots with a driver by long hitters larger, by making the distance for reducing the distance on shots with a driver and an iron by average hitters smaller, reduces the influence on play other than reducing the distance on shots with a driver by long hitters. In addition, due to the above changes, it is desirable to design the ball so that its spin characteristics in the short game have a similar performance to those of the ball used in the current tour so that a sense of discomfort does not occur for professionals or advanced players when using the golf ball with the reduced distance.

In the past, some golf balls in which an initial velocity of the ball is restricted to not more than 76.5 m/s have been proposed. Examples of such technical documents include the following Patent Documents 1 to 5.

However, each of the proposed golf balls is a practice ball for a driving range that is simply designed so as not to have a larger distance than a game ball. Therefore, the golf ball is not designed such that while reducing the distance on shots with a driver (W #1) by long hitters, the distance for reducing the distance of average hitters is made smaller than the distance for reducing the distance by long hitters.

Further, Patent Documents 6 to 14 listed below each disclose a golf ball in which, as for dimples formed on the ball surface, a sum of the volumes of the individual dimples, formed below the flat plane circumscribed by the edge of a dimple, to a ball spherical volume on the assumption that the ball has no dimples, that is, a dimple volume occupancy ratio VR, is specified within a predetermined value, whereby a superior distance can be obtained in the low HS range while reducing the distance in the high head speed (HS) range.

However, with the golf balls proposed above, the distance on shots with an iron by average hitters may be largely reduced. In addition, a run on shots with an iron increases too much, so that it can be difficult to stop the ball at an intended place. Therefore, it is desirable to develop a golf ball that reduces the influence on play as much as possible other than reducing the distance on shots with a driver by long hitters.

CITATION LIST

Patent Document 1: JP-A 2012-228470
Patent Document 2: JP-A 2014-069045
Patent Document 3: JP-A 2013-138857
Patent Document 4: JP-A 2013-138839
Patent Document 5: JP-A 2013-138840
Patent Document 6: JP-A 2011-218160
Patent Document 7: JP-A 2011-218161
Patent Document 8: JP-A 2011-218162
Patent Document 9: JP-A 2011-240122
Patent Document 10: JP-A 2011-240123
Patent Document 11: JP-A 2011-240124
Patent Document 12: JP-A 2011-240125
Patent Document 13: JP-A 2011-240126
Patent Document 14: JP-A 2011-240127

SUMMARY OF THE INVENTION

The present invention has been made in view of the above circumstances, and to address the possibility of there being a change to the rules in the future to suppress the distance by long hitters by changing the test conditions for the ODS of golf balls, an object of the present invention is to provide a golf ball that is intended to satisfy the needs of professionals or advanced players, instead of simply reducing distance, while making the distance for reducing the distance on shots with a driver by long hitters larger, by making the distance for reducing the distance on shots with a driver (W #1) by average hitters and with an iron smaller and reducing a run on shots with an iron and thus making the ball easy to stop at an intended place.

As a result of intensive studies to achieve the above object, the present inventors have found that in a multi-piece solid golf ball including a core, an intermediate layer, and a cover, in which a large number of dimples are formed on an outer surface of the cover, a relationship between a surface hardness of an intermediate layer-encased sphere and a surface hardness of the ball satisfies the following condition:

(surface hardness of ball)<(surface hardness of intermediate layer-encased sphere)

(where the surface hardnesses mean Shore C hardnesses).

Further, the present inventors have found that when an initial velocity of the ball is set to 76.5 to 77.724 m/s and a deflection set to less than 2.7 mm when the ball is compressed under a final load of 1,275 N (130 kgf) from an initial load of 98 N (10 kgf), and a value of (initial velocity of core× weight of core) is denoted by Ciw, a value of [(initial velocity of intermediate layer-encased sphere−initial velocity of core)×(weight of intermediate layer-encased sphere−weight of core)] is denoted by Miw, and a value of [(initial velocity of ball−initial velocity of intermediate layer-encased sphere)×(weight of ball−weight of intermediate layer-encased sphere)] is denoted by CViw, the following condition is satisfied:

$$2600 \leq Ciw + Miw + CViw \leq 2{,}715.$$

Further, the present inventors have found that, when a ratio CL1/CD1 of a lift coefficient CL1 at a Reynolds number of 218000 and a spin rate of 2800 rpm to a drag coefficient CD1 is denoted by A1, a ratio CL2/CD2 of a lift coefficient CL2 at a Reynolds number of 184000 and a spin rate of 2900 rpm to a drag coefficient CD2 is denoted by A2, and a ratio CL3/CD3 of a lift coefficient CL3 at a Reynolds number of 158000 and a spin rate of 3100 rpm to a drag coefficient CD3 is denoted by A3, by designing the golf ball to satisfy the following two conditions:

$0.590 \leq A1 \leq 0.655$ and $(A2+A3)/2 \geq 0.670$, in a golf ball conforming to the rules for suppressing the distance by long hitters, even if a distance for reducing a distance on shots with a driver by long hitters is made larger, making the distance for reducing each distance on shots with a driver (W #1) by average hitters and on shots with an iron as small as possible reduces an influence on play other than reducing the distance on shots with a driver by long hitters, and have completed the present invention.

In addition, the golf ball of the present invention has a similar performance to the ball used in the current tour with respect to its spin characteristics in the short game so that a sense of discomfort does not occur for professionals or advanced players when using the golf ball. Furthermore, the golf ball of the present invention can satisfy the needs of professionals or advanced players by making the ball easy to stop at an intended place without increasing a run on shots with an iron.

The above "long hitters" mean users whose head speed on shots with a driver (W #1) is at least about 50 m/s, and the above "average hitters" mean users whose head speed on shots with a driver (W #1) is not more than about 45 m/s.

Accordingly, the present invention provides a multi-piece solid golf ball including a core, an intermediate layer, and a cover, wherein a large number of dimples are formed on an outer surface of the cover, and a relationship between a surface hardness of an intermediate layer-encased sphere and a surface hardness of the ball satisfies the following condition:

(surface hardness of ball)<(surface hardness of intermediate layer-encased sphere)

(where the surface hardnesses mean Shore C hardnesses).

Further characteristics of the multi-piece solid golf ball are that when an initial velocity of the ball is 76.5 to 77.724 m/s and a deflection is less than 2.7 mm when the ball is compressed under a final load of 1,275 N (130 kgf) from an initial load of 98 N (10 kgf), a value of (initial velocity of core×weight of core) is denoted by Ciw, a value of [(initial velocity of intermediate layer-encased sphere−initial velocity of core)×(weight of intermediate layer-encased sphere−weight of core)] is denoted by Miw, and a value of [(initial velocity of ball−initial velocity of intermediate layer-encased sphere)×(weight of ball−weight of intermediate layer-encased sphere)] is denoted by CViw, the following condition is satisfied:

$2{,}600 \leq Ciw+Miw+CViw \leq 2{,}715$, and when a ratio CL1/CD1 of a lift coefficient CL1 at a Reynolds number of 218000 and a spin rate of 2800 rpm to a drag coefficient CD1 is denoted by A1, a ratio CL2/CD2 of a lift coefficient CL2 at a Reynolds number of 184000 and a spin rate of 2900 rpm to a drag coefficient CD2 is denoted by A2, and a ratio CL3/CD3 of a lift coefficient CL3 at a Reynolds number of 158000 and a spin rate of 3100 rpm to a drag coefficient CD3 is denoted by A3, the following two conditions are satisfied:

$0.590 \leq A1 \leq 0.655$ and $(A2+A3)/2 \geq 0.670$.

In a preferred embodiment of the multi-piece solid golf ball according to the invention, a volume occupancy ratio VR of the dimples is 0.77 to 0.92%.

In another preferred embodiment of the inventive golf ball, the value of (A2+A3)/2 is 0.670 to 0.783.

In yet another preferred embodiment, the value of A2 is 0.635 to 0.750, and the value of A3 is 0.695 to 0.815.

In still another preferred embodiment, a relationship between a surface hardness of the core and the surface hardness of the intermediate layer-encased sphere satisfies the following condition:

(surface hardness of intermediate layer-encased sphere)≥(surface hardness of core)

[where the surface hardnesses mean Shore C hardnesses].

In a further preferred embodiment, when the initial velocity of the core is denoted by Vc (m/s), and a deflection is denoted by C (mm) when the core is compressed under a final load of 1,275 N (130 kgf) from an initial load of 98 N (10 kgf), the following condition is satisfied:

$20 \leq Vc/C \leq 30$.

In a yet further preferred embodiment, when each sphere of the core, the intermediate layer-encased sphere, and the ball is compressed under a final load of 1,275 N (130 kgf) from an initial load of 98 N (10 kgf) and the deflections (mm) are denoted by C (mm), M (mm), and B (mm) respectively, the following two conditions are satisfied:

$0.30 \leq C-B \leq 0.90$ $0.30 \leq C-M \leq 0.65$.

In a still further preferred embodiment, when the core is compressed under a final load of 1,275 N (130 kgf) from an initial load of 98 N (10 kgf) and the deflection (mm) is denoted by C (mm), the following condition is satisfied:

$700 \leq Ciw/C \leq 1000$.

In a yet further preferred embodiment, the core has a hardness profile in which, letting the Shore C hardness at a core center be Cc, the Shore C hardness at a midpoint M between the core center and a core surface be $C_m$, the Shore C hardnesses at positions 2 mm, 4 mm, and 6 mm inward from the midpoint M be Cm−2, Cm−4, and Cm−6 respectively, the Shore C hardnesses at positions 2 mm, 4 mm, and 6 mm outward from the midpoint M be Cm+2, Cm+4, and Cm+6 respectively, and the Shore C hardness at the core surface be Cs, and defining surface areas A to F as follows:

surface area $A$: $\frac{1}{2} \times 2 \times (Cm-4-Cm-6)$ surface area $B$: $\frac{1}{2} \times 2 \times (Cm-2-Cm-4)$ surface area $C$: $\frac{1}{2} \times 2 \times (Cm-Cm-2)$ surface area $D$: $\frac{1}{2} \times 2 \times (Cm+2-Cm)$ surface area $E$: $\frac{1}{2} \times 2 \times (Cm+4-Cm+2)$ surface area $F$: $\frac{1}{2} \times 2 \times (Cm+6-Cm+4)$ the following condition is satisfied:

{(surface area $D$+surface area $E$)−(surface area $A$+surface area $B$)}≥4.0.

In a still further preferred embodiment, the core has a hardness profile in which the following condition is satisfied:

$(Cs-Cc) \geq 22$.

In a yet further preferred embodiment, the core has a hardness profile in which the following condition is satisfied:

$(Cs-Cc)/(Cm-Cc) \geq 4.0$.

In a still further preferred embodiment, the core has a hardness profile in which the following condition is satisfied:

surface area *E*>surface area *D*>surface area *C*.

Advantageous Effects of the Invention

To address the possibility of there being a change to the rules in the future to suppress the distance by long hitters by the R&A and the USGA by changing the test conditions for the ODS of golf balls, with the golf ball of the present invention, instead of simply reducing the distance, making a distance for reducing the distance on shots with a driver by long hitters larger, and making the distance for reducing the distance on shots with a driver (W #1) by average hitters and the distance on shots with an iron smaller may reduce an influence on play other than reducing the distance on shots with a driver by long hitters. In addition, the golf ball of the present invention has a similar performance to the ball used in the current tour with respect to its spin characteristics in the short game so that a sense of discomfort does not occur for professionals or advanced players when using the golf ball. Furthermore, the needs of professionals or advanced players can be satisfied by making the ball easy to stop at an intended place without increasing a run on shots with an iron.

BRIEF DESCRIPTION OF THE DRAWINGS

FIG. 6A shows a plan view of the dimples, and FIG. 6B shows a side view thereof; and 10;

FIG. 7A shows a plan view of the dimples, and FIG. 7B shows a side view thereof.

DETAILED DESCRIPTION OF THE INVENTION

Hereinafter, the present invention is described in more detail.

Figure 1:
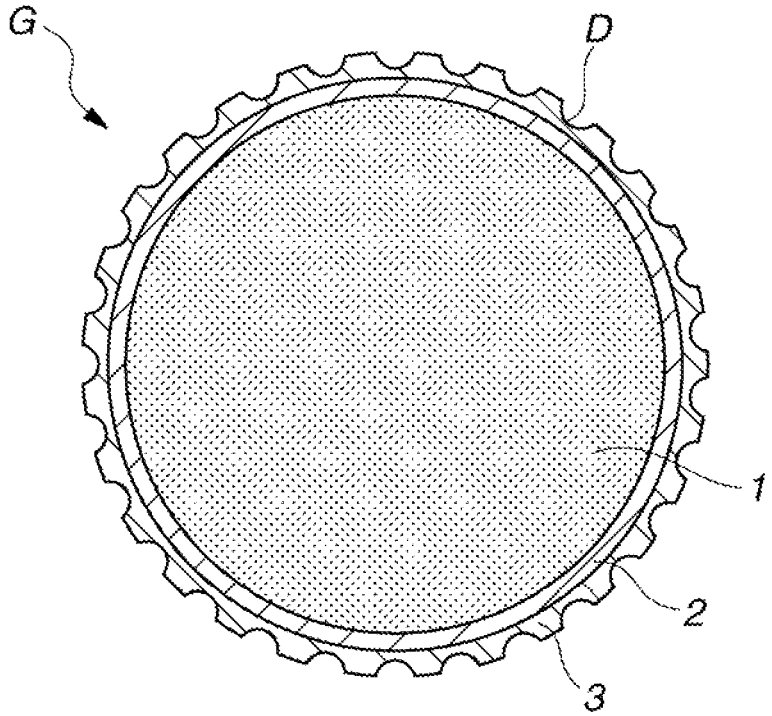
FIG. 1 is a schematic cross-sectional view of a golf ball according to one embodiment of the present invention.

A multi-piece solid golf ball according to the present invention has a core, an intermediate layer, and a cover, and an example thereof is shown in FIG. 1, for example. A golf ball G shown in FIG. 1 has a single-layer core 1, a single-layer intermediate layer 2 encasing the core 1, and a single-layer cover 3 encasing the intermediate layer. The cover 3 is positioned at the outermost layer in the layer construction of the golf ball except for the coating layer. In addition to a single layer as shown in FIG. 1, each layer of the core and the intermediate layer may be formed as a plurality of layers. A large number of dimples D are typically formed on the surface of the cover (outermost layer) 3 in order to improve the aerodynamic properties of the ball. In addition, although not particularly illustrated, a coating layer is typically formed on the surface of the cover 3. Hereinafter, each of the above layers is described in detail.

The core is obtained by vulcanizing a rubber composition containing a rubber material as a chief material. If the core material is not a rubber composition, the rebound of the core may become low, and a desired distance may not be attainable on shots with a driver (W #1) and an iron by average hitter. This rubber composition typically contains a base rubber as a chief material, and is obtained with the inclusion of a co-crosslinking agent, a crosslinking initiator, an inert filler, an organosulfur compound, or the like.

Examples of the core are preferably formed of a rubber composition containing, in particular, the following components (A) to (E):

(A) base rubber,
(B) co-crosslinking agent,
(C) water or monocarboxylic acid metal salt,
(D) organic peroxide, and
(E) organosulfur compound.

The base rubber (A) may include a diene rubber. Examples of the diene rubber include polybutadiene, natural rubber, isoprene rubber, and ethylene propylene diene rubber.

The co-crosslinking agent (B) is an α,β-unsaturated carboxylic acid and/or a metal salt thereof. Specific examples of the unsaturated carboxylic acid include acrylic acid, methacrylic acid, maleic acid, fumaric acid, or the like, and in particular, acrylic acid and methacrylic acid are suitably used. The metal salt of the unsaturated carboxylic acid is not particularly limited, and examples thereof include those obtained by neutralizing the unsaturated carboxylic acid with a desired metal ion. Specific examples thereof include zinc salts and magnesium salts such as methacrylic acid and acrylic acid, and in particular, zinc acrylate is suitably used.

The unsaturated carboxylic acid and/or the metal salt thereof is typically blended in an amount of at least 5 parts by weight, preferably at least 9 parts by weight, and even more preferably at least 13 parts by weight, and the upper limit is typically not more than 60 parts by weight, preferably not more than 50 parts by weight, and even more preferably not more than 40 parts by weight per 100 parts by weight of the base rubber. If the compounding amount is too large, the core may become too hard, giving the ball an unpleasant feel at impact, and if the compounding amount is too small, the rebound may become low.

The water (C) is not particularly limited and may be distilled water or tap water, in particular, it is suitable to employ distilled water free of impurities. The compounding amount of the water included per 100 parts by weight of the base rubber is preferably at least 0.1 parts by weight, and more preferably at least 0.2 parts by weight, and the upper limit is preferably not more than 2 parts by weight, and more preferably not more than 1 part by weight.

By blending the water or a water-containing material as the component (C) directly into the core material, decomposition of the organic peroxide during the core formulation can be promoted. In addition, it is known that the decomposition efficiency of the organic peroxide in the core-forming rubber composition changes depending on temperature, and the decomposition efficiency increases as the temperature becomes higher than a certain temperature. If the temperature is too high, the amount of decomposed radicals becomes too large, and the radicals are recombined or deactivated. As a result, fewer radicals act effectively in crosslinking. Here, when decomposition heat is generated by the decomposition of the organic peroxide at the time of core vulcanization, a temperature near the core surface is maintained at substantially the same level as a temperature of a vulcanization mold, but the temperature around the core center is considerably higher than the mold temperature due to an accumulation of decomposition heat by the organic peroxide decomposing from the outside. If the water or a material containing water is directly included in the core, the water acts to promote the decomposition of the organic peroxide, so that the radical reactions as described above can be changed at the core center and the core surface. That is, the decomposition of the organic peroxide is further promoted near the core center, and the deactivation of radicals is further promoted, so that the amount of active radicals is further reduced, and as a result, a core can be obtained in which the crosslink densities at the core center and the core surface differ markedly, and the dynamic viscoelasticity of the core center portion is different.

In addition, a monocarboxylic acid metal salt can be employed instead of the water. In the monocarboxylic acid metal salt, it is presumed that a carboxylic acid is coordinate-bonded to the metal salt, and the monocarboxylic acid metal salt is distinguished from a dicarboxylic acid metal salt such as zinc diacrylate of $[CH_2{=}CHCOO]_2Zn$ in a chemical formula. The monocarboxylic acid metal salt brings water into the rubber composition by subjecting the monocarboxylic acid metal salt to a dehydration condensation reaction, so that the same effect as that of the water can be obtained. In addition, since the monocarboxylic acid metal salt can be blended in the rubber composition as powder, the working process can be simplified, and it is easy to uniformly disperse the monocarboxylic acid metal salt in the rubber composition. In order to effectively perform the above reaction, it is necessary to use a mono-salt. The compounding amount of the monocarboxylic acid metal salt is preferably at least 1 part by weight, and more preferably at least 3 parts by weight per 100 parts by weight of the base rubber. As the upper limit thereof, the compounding amount of the monocarboxylic acid metal salt is preferably not more than 60 parts by weight, and more preferably not more than 50 parts by weight. If the compounding amount of the monocarboxylic acid metal salt is too small, it is difficult to obtain an appropriate crosslinking density, and it may not be possible to obtain an adequate golf ball spin rate-lowering effect. In addition, if the compounding amount is too large, the core becomes too hard, so that it may be difficult to maintain an appropriate feel at impact.

As the carboxylic acid, an acrylic acid, a methacrylic acid, a maleic acid, a fumaric acid, a stearic acid, or the like may be used. Examples of a substitute metal include Na, K, Li, Zn, Cu, Mg. Ca, Co, Ni, and Pb, and Zn is preferably used. Specific examples thereof include a zinc monoacrylate and a zinc monomethacrylate, and it is particularly preferable to use a zinc monoacrylate.

As the organic peroxide (D), an organic peroxide having a relatively high thermal decomposition temperature is preferably used, and specifically, a high-temperature organic peroxide having a one-minute half-life temperature of about from 165 to 185° C. is used, and examples thereof include a dialkyl peroxide. Examples of the dialkyl peroxide include a dicumyl peroxide ("PERCUMYL® D" manufactured by NOF Corporation), a 2,5-dimethyl-2,5-di(t-butylperoxy) hexane ("PERHEXA® 25B" manufactured by NOF Corporation), and a di(2-t-butylperoxyisopropyl) benzene ("PERBUTYL® P" manufactured by NOF Corporation), and a dicumyl peroxide may be suitably used. These may be used singly, or two or more may be used in combination. The half-life is one of the indices indicating a degree of a decomposition rate of the organic peroxide, and is indicated by a time required for the original organic peroxide to be decomposed and its active oxygen amount to reach ½. A vulcanization temperature in the rubber composition for the core is typically within a range of from 120 to 190° C., and in that range, an organic peroxide having a one-minute half-life temperature of a high temperature, which is about from 165° C. to 185° C., is thermally decomposed relatively slowly. With the rubber composition used in the present invention, by adjusting the amount of free radicals produced, which increases with the lapse of a vulcanization time, it is possible to obtain a core that is a rubber cross-linked product having a specific internal hardness shape described later.

The organosulfur compound (E) may be blended in order to control the rebound of the core so that it is increased. As the organosulfur compound, specifically, it is recommended to include thiophenol, thionaphthol, halogenated thiophenol, or a metal salt thereof. More specifically, examples of the organosulfur compound include zinc salts such as pentachlorothiophenol, pentafluorothiophenol, pentabromothiophenol, p-chlorothiophenol, and pentachlorothiophenol, and any of the following having 2 to 4 sulfur atoms: diphenylpolysulfide, dibenzylpolysulfide, dibenzoylpolysulfide, dibenzothiazoylpolysulfide, and dithiobenzoylpolysulfide. In particular, diphenyldisulfide and the zinc salt of pentachlorothiophenol is preferably used.

The upper limit of the compounding amount of the organosulfur compound is preferably not more than 5 parts by weight, more preferably not more than 4 parts by weight, further more preferably not more than 3 parts by weight, and most preferably not more than 2 parts by weight per 100 parts by weight of the base rubber. If the compounding amount is too large, the core hardness becomes too soft and the rebound of the core becomes too high, and the distance on shots with a driver by long hitters may be too large. On the other hand, the lower limit of the compounding amount is preferably at least 0.1 parts by weight, more preferably at least 0.2 parts by weight, and even more preferably at least 0.5 parts by weight per 100 parts by weight of the base rubber. If the compounding amount is too small, the rebound of the core may be too low, so that the distance on shots with a driver by average hitters and with an iron by both long hitters and average hitters may be largely lowered.

In the rubber composition, a filler, an antioxidant, and the like can be blended as components other than the components (A) to (E).

As a filler, for example, zinc oxide, barium sulfate, calcium carbonate, or the like may be suitably used. These may be used singly, or two or more may be used in combination. The compounding amount of the filler may be preferably at least 4 parts by weight, and more preferably at least 8 parts by weight, and even more preferably at least 12 parts by weight per 100 parts by weight of the base rubber. In addition, the upper limit of the compounding amount is preferably not more than 50 parts by weight, more preferably not more than 40 parts by weight, and even more preferably not more than 30 parts by weight per 100 parts by weight of the base rubber. If the compounding amount is too large or too small, it may not be possible to obtain an appropriate weight and a suitable rebound.

As an antioxidant, for example, commercially available products such as Nocrac NS-6, Nocrac NS-30, Nocrac NS-200, and Nocrac MB (all manufactured by Ouchi Shinko Chemical Industrial Co., Ltd.) may be employed. These may be used singly, or two or more may be used in combination.

The compounding amount of the antioxidant is, although not particularly limited, preferably at least 0.05 parts by weight, and more preferably at least 0.1 parts by weight, and the upper limit is preferably not more than 1.0 part by weight, more preferably not more than 0.7 parts by weight, and even more preferably not more than 0.5 parts by weight per 100 parts by weight of the base rubber. If the compounding amount is too large or too small, a suitable core hardness gradient may not be attainable, and it may not be possible to obtain a suitable rebound, durability, and a spin rate-lowering effect on full shots.

The core can be manufactured by vulcanizing and curing the rubber composition containing the above components. For example, a molded body can be manufactured by intensively mixing the rubber composition using a mixing apparatus such as a Banbury mixer or a roll mill, subsequently compression molding or injection molding the mixture using a core mold, and curing the resulting molded body by appropriately heating it at a temperature sufficient for the organic peroxide or the co-crosslinking agent to act, such as at a temperature of from 100 to 200° C., and preferably at a temperature of from 140 to 180° ° C., for from 10 to 40 minutes.

In the present invention, the core is formed as a single layer or a plurality of layers, although it is preferably formed as a single layer. If the rubber core is produced as a plurality of layers of rubber, layer separation at the interfaces may arise when the ball is repeatedly struck, possibly leading to a cracking in earlier timing.

The diameter of the core is preferably at least 37.5 mm, more preferably at least 38.0 mm, and even more preferably at least 38.4 mm. The upper limit of the diameter of the core is preferably not more than 40.0 mm, more preferably not more than 39.4 mm, and even more preferably not more than 38.8 mm. If the diameter of the core is too small, the initial velocity of the ball may become too low, or a deflection of the entire ball may become small, so that the spin rate of the ball on full shots may rise, and a desired distance may not be attainable on shots with a driver (W #1) by average hitters and on shots with an iron. On the other hand, if the diameter of the core is too large, the spin rate on full shots may rise, and the desired distance of average hitters may not be attainable, or a durability to cracking on repeated impact may worsen.

The deflection (mm) when the core is compressed under a final load of 1,275 N (130 kgf) from an initial load of 98 N (10 kgf) is not particularly limited, but is preferably at least 2.5 mm, more preferably at least 2.7 mm, and even more preferably at least 2.9 mm, and the upper limit thereof is preferably not more than 3.9 mm, more preferably not more than 3.6 mm, and even more preferably not more than 3.3 mm. If the deflection of the core is too small, that is, the core is too hard, and a desired distance may not be attainable on shots with a driver (W #1) by average hitters and on shots with an iron, or the feel at impact may be too hard. On the other hand, if the deflection of the core is too large, that is, if the core is too soft, the ball rebound may become too low and a good distance may not be achieved for average hitters, or the feel at impact may be too soft, or the durability to cracking on repeated impact may worsen, and a run on shots with an iron may increase too much.

Next, the core hardness profile is described. The hardness of the core described below means Shore C hardness. The Shore C hardness is a hardness value measured with a Shore C durometer conforming to the ASTM D2240 standard.

A core center hardness (Cc) is preferably at least 57, more preferably at least 59, and even more preferably at least 61, and the upper limit is preferably not more than 67, more preferably not more than 65, and even more preferably not more than 63. If this value is too large, the spin rate of the ball on full shots may rise, so that a desired distance may not be attainable on shots with a driver (W #1) by average hitters and on shots with an iron, or the feel at impact may be too hard. On the other hand, if the above value is too small, the rebound may become low and a desired distance for average hitters may not be attainable, or the durability to cracking on repeated impact may worsen, and a run on shots with an iron may increase, which may fail to satisfy the needs of professionals or advanced players.

A hardness (Cm−6) at a position 6 mm inward from the point M (hereinafter, also referred to as "midpoint M") between the core center and the core surface is not particularly limited, but may be preferably at least 58, more preferably at least 60, and even more preferably at least 62, and the upper limit is also not particularly limited, and may be preferably not more than 68, more preferably not more than 66, and even more preferably not more than 64. Hardnesses that deviate from these values may lead to undesirable results similar to those described above for the core center hardness (Cc).

A hardness (Cm−4) at a position 4 mm inward from the point M (hereinafter, also referred to as "midpoint M") between the core center and the core surface is not particularly limited, but may be preferably at least 60, more preferably at least 62, and even more preferably at least 64, and the upper limit is also not particularly limited, and may be preferably not more than 69, more preferably not more than 67, and even more preferably not more than 65. Hardnesses that deviate from these values may lead to undesirable results similar to those described above for the core center hardness (Cc).

A hardness (Cm−2) at a position 2 mm inward from the midpoint M of the core is not particularly limited, but may be preferably at least 61, more preferably at least 63, and even more preferably at least 65. The upper limit is also not particularly limited, and may be preferably not more than 70, more preferably not more than 68, and even more preferably not more than 66. Hardnesses that deviate from these values may lead to undesirable results similar to those described above for the core center hardness (Cc).

A cross-sectional hardness (Cm) at the midpoint M of the core is not particularly limited, but may be preferably at least 62, more preferably at least 64, and even more preferably at least 66. In addition, the upper limit is not particularly limited, but may be preferably not more than 71, more preferably not more than 69, and even more preferably not more than 67. Hardnesses that deviate from these values may lead to undesirable results similar to those described above for the core center hardness (Cc).

A core surface hardness (Cs) is preferably at least 80, more preferably at least 82, and even more preferably at least 84. The upper limit is preferably not more than 91, more preferably not more than 89, and even more preferably not more than 87. If this value is too large, the durability to cracking on repeated impact may worsen, or the feel at impact may be too hard. On the other hand, if this value is too small, the rebound may decrease or the spin rate of the ball on full shots may rise, so that a desired distance may not be attainable on shots with a driver (W #1) by average hitters and on shots with an iron.

A hardness (Cm+2) at a position 2 mm outward toward the core surface (hereinafter, simply referred to as "outward") from the midpoint M of the core toward the core surface is not particularly limited, but may be preferably at least 66, more preferably at least 68, and even more preferably at least 70. The upper limit is also not particularly limited, and may be preferably not more than 75, more preferably not more than 73, and even more preferably not more than 71. Hardnesses that deviate from these values may lead to undesirable results similar to those described above for the core surface hardness (Cs).

A hardness (Cm+4) at a position 4 mm outward from the midpoint M of the core is not particularly limited, but may be preferably at least 71, more preferably at least 73, and even more preferably at least 75. The upper limit also not particularly limited, and may be preferably not more than 80, more preferably not more than 78, and even more preferably not more than 76. Hardnesses that deviate from these values may lead to undesirable results similar to those described above for the core surface hardness (Cs).

A hardness (Cm+6) at a position 6 mm outward from the midpoint M of the core is not particularly limited, but may be preferably at least 75, more preferably at least 77, and even more preferably at least 79. The upper limit also not particularly limited, and may be preferably not more than 85, more preferably not more than 83, and even more preferably not more than 81. Hardnesses that deviate from these values may lead to undesirable results similar to those described above for the core surface hardness (Cs).

A value obtained by subtracting the core center hardness from the core surface hardness, that is, the value of Cs−Cc, is preferably at least 22, more preferably at least 23, and even more preferably at least 24. The upper limit is preferably not more than 32, more preferably not more than 29, and even more preferably not more than 26. If this value is too small, the spin rate of the ball on full shots may rise, so that a desired distance may not be attainable on shots with a driver (W #1) by average hitters and on shots with an iron. On the other hand, if this value is too large, the rebound becomes low so that a desired distance may not be attainable on shots with a driver (W #1) by average hitters and on shots with an iron, or the durability to cracking on repeated impact may worsen.

In addition, it is preferable to optimize the value of (Cs−Cc)/(Cm−Cc) for the core hardness profile. The value of (Cs−Cc) indicates a difference in hardness between the core center and the core surface, and a value of (Cm−Cc) indicates a difference in hardness between the core center and the midpoint between the core surface and the core center, and the above expression represents the ratio of these differences in hardness. The value of (Cs−Cc)/(Cm−Cc) is preferably at least 4.0, more preferably at least 5.0, and even more preferably at least 6.0. The upper limit is preferably not more than 12.0, more preferably not more than 11.0, and even more preferably not more than 9.5. If this value is too small, the spin rate of the ball on full shots may rise, so that a desired distance may not be attainable on shots with a driver (W #1) by average hitters and on shots with an iron. On the other hand, if this value is too large, the rebound becomes low so that a desired distance may not be attainable on shots with a driver (W #1) by average hitters and on shots with an iron by both average hitters and long hitters, or the durability to cracking on repeated impact may worsen.

In the core hardness profile, the surface areas A to F defined as follows:

surface area $A$: $\frac{1}{2}\times 2\times(Cm-4-Cm-6)$ surface area $B$: $\frac{1}{2}\times 2\times(Cm-2-Cm-4)$ surface area $C$: $\frac{1}{2}\times 2\times(Cm-Cm-2)$ surface area $D$: $\frac{1}{2}\times 2\times(Cm+2-Cm)$ surface area $E$: $\frac{1}{2}\times 2\times(Cm+4-Cm+2)$ surface area $F$: $\frac{1}{2}\times 2\times(Cm+6-Cm+4)$ are characterized in that a value of (surface area D+surface area E)−(surface area A+surface area B) is preferably at least 4.0, more preferably at least 5.0, and more preferably at least 6.0, and the upper limit is preferably not more than 12.0, more preferably not more than 10.0, and even more preferably not more than 8.0. If this value is too small, the spin rate of the ball on full shots may rise, so that a desired distance may not be attainable on shots with a driver (W #1) by average hitters and on shots with an iron. On the other hand, if this value is too large, the rebound becomes low so that a desired distance may not be attainable on shots with a driver (W #1) by average hitters and on shots with an iron, or the durability to cracking on repeated impact may worsen.

In addition, the relationship of each surface area calculated from the core hardness profile preferably satisfies the flowing condition:

surface area E>surface area D>surface area C. If relational expression is not satisfied, the spin rate of the ball on full shots may rise, so that a desired distance may not be attainable on shots with a driver (W #1) by average hitters and on shots with an iron.

Further, it is preferable to optimize the value of the following condition:

$$\{(\text{surface area } D+\text{surface area } E)-(\text{surface area } A+\text{surface area } B)\}\times(Cs-Cc).$$

This value is at least 120, preferably at least 130, and more preferably at least 140. The upper limit is preferably not more than 220, more preferably not more than 200, and even more preferably not more than 190. If this value is too small, the spin rate of the ball on full shots may rise, so that a desired distance may not be attainable on shots with a driver (W #1) by average hitters and on shots with an iron. On the other hand, if this value is too large, the rebound becomes low so that a desired distance may not be attainable on shots with a driver (W #1) by average hitters and on shots with an iron, or the durability to cracking on repeated impact may worsen.

Figure 2:
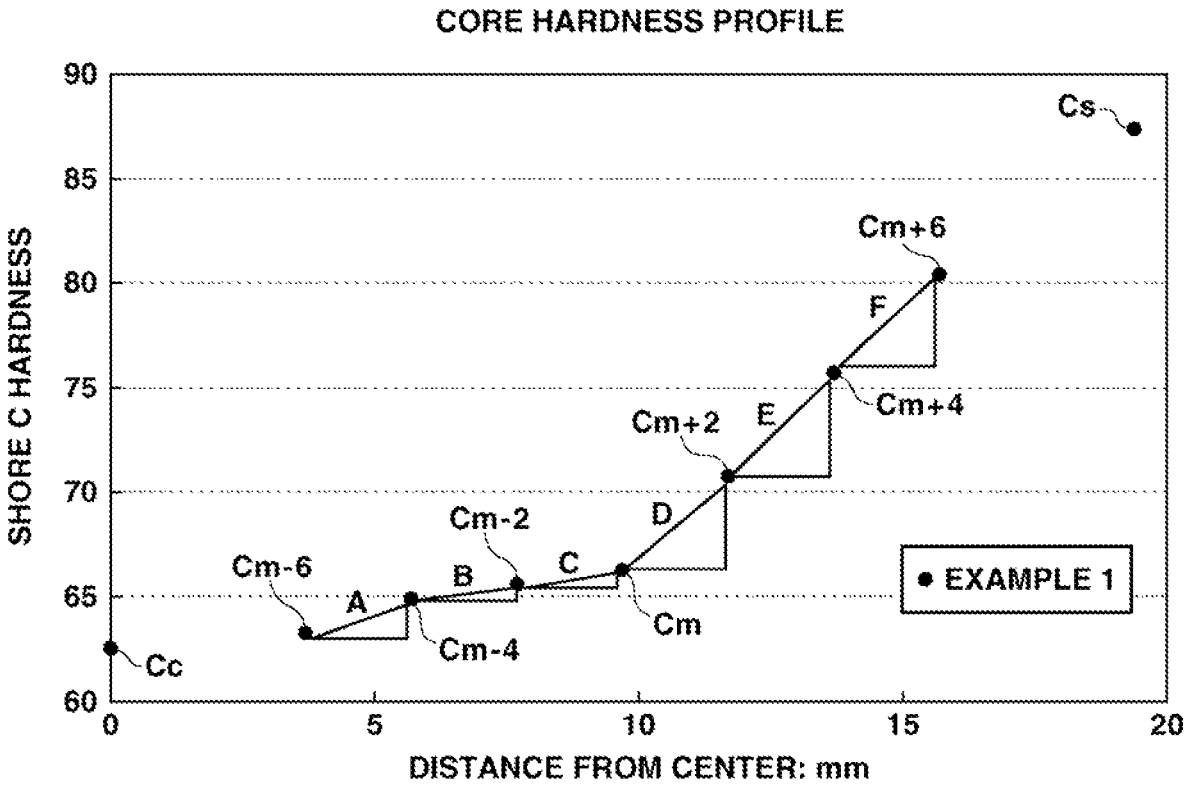
FIG. 2 is a graph that uses core hardness profile data in Example 1 to describe surface areas A to F in a core hardness profile.

FIG. 2 shows a graph describing the surface areas A to F using the core hardness profile data of Example 1. In this way, the surface areas A to F are surface areas of each triangle whose base is a difference between each specific distance and whose height is a difference in hardness between each position at these specific distances.

An initial velocity of the core is preferably at least 75.6 m/s, more preferably at least 76.0 m/s, and even more preferably at least 76.4 m/s. The upper limit is not more than 78.0 m/s, preferably not more than 77.2 m/s, and more preferably not more than 76.8 m/s. If this initial velocity value is too high, the extent to which the distance with respect to the current tour ball is reduced on shots with a driver by long hitters is inadequate, and there is a possibility that the distance is too large compared with the standard distance of the new distance rules assumed by the R&A and the USGA. On the other hand, if the initial velocity is too low, a desired distance may not be attainable on shots with a driver (W #1) by average hitters and on shots with an iron. The value of the initial velocity in this case is a numerical value measured by a device for measuring a coefficient of restitution (COR) (Golf Ball Testing Machine) of the same type as the R&A. Specifically, a device for measuring a COR manufactured by Hye Precision USA is used. As a condition, at the time of measurement, an air pressure is changed in four stages and measured, a relational expression between the incident velocity and the COR is constructed, and the initial velocity at an incident velocity of 43.83 m/s is determined from the relational expression. For a measurement environment of the device for measuring a COR, a ball temperature-controlled for at least three hours in a thermostatic bath adjusted to 23.9+1° C. is used, and measurement is performed at a room temperature of 23.9+2° C. In addition, a barrel diameter is selected such that a clearance on one side with respect to an outer diameter of the object being measured is from 0.2 to 2.0 mm.

When the initial velocity of the core is denoted by Vc (m/s), and the deflection is denoted by C (mm) when the core is compressed under a final load of 1,275 N (130 kgf) from an initial load of 98 N (10 kgf), the value of Vc/C is preferably at least 19, more preferably at least 21, and even more preferably at least 23. The upper limit is preferably not more than 31, more preferably not more than 29, and even more preferably not more than 27. If this value is too large, the extent to which the distance with respect to the current tour ball is reduced on shots with a driver by long hitters is inadequate, and there is a possibility that the distance is too large compared with the standard distance of the new distance rules assumed by the R&A and the USGA. On the other hand, if the value is too small, a desired distance may not be attainable on shots with a driver (W #1) by average hitters and on shots with an iron.

When the value of (initial velocity of core×weight of core) is denoted by Ciw, Ciw means a value indicating the rebound of the core material portion in relation to its parts by weight. Ciw is preferably at least 2,600, more preferably at least 2,640, and even more preferably at least 2,670. The upper limit is preferably not more than 2,770, more preferably not more than 2,740 and even more preferably not more than 2,710. If this value deviates from the above ranges, a desired distance may not be attainable on shots with a driver (W #1) by average hitters and on shots with an iron, and a run on shots with an iron may increase too much, which may fail to satisfy the needs of professionals or advanced players.

When the core is compressed under a final load of 1,275 N (130 kgf) from an initial load of 98 N (10 kgf) and the deflection (mm) is denoted by C (mm), the value of Ciw/C means a distribution amount with respect to a certain deflection in a quantitative index obtained by multiplying the rebound of the core material portion and its parts by weight. Ciw/C is preferably at least 700, more preferably at least 760, and even more preferably at least 820. The upper limit is preferably not more than 1000, more preferably not more than 970, and even more preferably not more than 930. If this value deviates from the above ranges, a desired distance may not be attainable on shots with a driver (W #1) by average hitters and on shots with an iron, and a run on shots with an iron may increase too much, which may fail to satisfy the needs of professionals or advanced players.

Next, the intermediate layer is described.

The intermediate layer has a material hardness on the Shore C hardness scale which, although not particularly limited, is preferably at least 90, more preferably at least 92, and even more preferably at least 93. The upper limit is preferably not more than 100, more preferably not more than 98, and even more preferably not more than 96. The surface hardness on the Shore D hardness scale is preferably at least 61, more preferably at least 63, and even more preferably at least 65. The upper limit is preferably not more than 72, more preferably not more than 70, and even more preferably not more than 67.

The sphere obtained by encasing the core with the intermediate layer (intermediate layer-encased sphere) has a surface hardness which, on the Shore C hardness scale, is preferably at least 95, more preferably at least 96, and even more preferably at least 97. The upper limit is preferably not more than 100, more preferably not more than 99, and even more preferably not more than 98. The surface hardness on the Shore D hardness scale is preferably at least 68, more preferably at least 69, and even more preferably at least 70. The upper limit is preferably not more than 78, more preferably not more than 75, and even more preferably not more than 72.

If the material hardness and the surface hardness of the intermediate layer are too soft in comparison with the above ranges, the spin rate may rise excessively on full shots, or an actual initial velocity on shots may become low, so that the distance on shots with a driver (W #1) by average hitters and an iron may not be increased. On the other hand, if the material hardness and the surface hardness of the intermediate layer are too hard in comparison with the above ranges, the durability to cracking on repeated impact may worsen, or the feel at impact on shots with a putter or on short approaches may become too hard, and the ball may be less likely to spin on approach shots.

The intermediate layer has a thickness which is preferably at least 0.9 mm, more preferably at least 1.0 mm, and even more preferably at least 1.1 mm. The intermediate layer thickness has an upper limit that is preferably not more than 1.6 mm, more preferably not more than 1.4 mm, and even more preferably not more than 1.2 mm. It is preferable for the intermediate layer to be thicker than the subsequently described cover. If the intermediate layer thickness falls outside of the above ranges or is thinner than that of the cover, the spin rate-lowering effect on shots with a driver (W #1) may be inadequate, and the intended distance on shots with a driver (W #1) by average hitters and with an iron may not be increased. Also, when the intermediate layer is too thin, the durability to cracking on repeated impact may worsen. On the other hand, if the thickness of the intermediate layer is too thick than the above range, the feel at impact may worsen.

The value obtained by subtracting the cover thickness from the intermediate layer thickness is preferably larger than 0 mm, more preferably at least 0.2 mm, and even more preferably at least 0.3 mm. The upper limit is preferably not more than 0.8 mm, more preferably not more than 0.6 mm, and even more preferably not more than 0.4 mm. If this value deviates from the above ranges, the spin rate of the ball on full shots rises, the actual initial velocity on shots becomes lower, or the like, so that the distance on shots with a driver (W #1) by average hitters and on shots with an iron may not be increased. On the other hand, if this value is too small, the durability to cracking on repeated impact may worsen.

As a material of the intermediate layer, it is suitable to employ an ionomer resin as a chief material. If an ionomer resin is employed as the chief material, an aspect that uses in admixture a zinc-neutralized ionomer resin and a sodium-neutralized ionomer resin as the chief materials is desirable. The blending ratio in terms of zinc-neutralized ionomer resin/sodium-neutralized ionomer resin (weight ratio) is from 5/95 to 95/5, preferably from 10/90 to 90/10, and more preferably from 15/85 to 85/15. If the zinc-neutralized ionomer and the sodium-neutralized ionomer are not included in this ratio, the rebound may become too low and the distance on shots with a driver (W #1) by average hitters and on shots with an iron may not be increased, and further, the durability to cracking on repeated impact at room temperature may worsen, and the durability to cracking at a low temperature (below zero) may worsen.

The ionomer resin material suitably contains a high-acid ionomer resin having an unsaturated carboxylic acid content (also referred to as "acid content") of at least 16 wt %.

The amount of high-acid ionomer resin included per 100 wt % of the resin material is preferably at least 25 wt %, more preferably at least 50 wt %, and even more preferably at least 75 wt %. The upper limit is preferably not more than 100 wt %, more preferably not more than 90 wt %, and even more preferably not more than 85 wt %. When the compounding amount of this high-acid ionomer resin is too low, the spin rate of the ball on full shots may rise and a good distance may not be attained. On the other hand, when the compounding amount of this high-acid ionomer resin is too high, the durability to repeated impact may worsen.

In the intermediate layer material, an optional additive may be appropriately included depending on the intended use. For example, various additives such as a pigment, a dispersant, an antioxidant, an ultraviolet absorber, and a light stabilizer can be included. If these additives are included, the compounding amount thereof is preferably at least 0.1 parts by weight, and more preferably at least 0.5 parts by weight, and an upper limit thereof is preferably not more than 10 parts by weight, and more preferably not more than 4 parts by weight per 100 parts by weight of the base resin.

For the intermediate layer material, it is suitable to abrade the surface of the intermediate layer in order to increase the degree of adhesion to a polyurethane suitably used in a cover material described later. Further, it is preferable that a primer (adhesive agent) is applied to the surface of the intermediate layer after the abrasion treatment, or an adhesion reinforcing agent is added to the intermediate layer material.

When the sphere (intermediate layer-encased sphere) in which the core is encased with the intermediate layer is compressed under a final load of 1,275 N (130 kgf) from an initial load of 98 N (10 kgf), the deflection (mm) is preferably at least 2.0 mm, more preferably at least 2.2 mm, and even more preferably at least 2.4 mm. The deflection upper limit is preferably not more than 3.4 mm, more preferably not more than 3.1 mm, and even more preferably not more than 2.8 mm. If the deflection of the intermediate layer-encased sphere is too small, that is, if the sphere is too hard, the spin rate of the ball rises and the distance on shots with a driver (W #1) by average hitters and on shots with an iron may not be increased, or the feel at impact may be too hard. On the other hand, if the deflection is too large, that is, if the sphere is too soft, the spin rate decreases and a run increases too much on shots with an iron, it may be difficult to control the desired distance, the feel at impact may be too soft, or the durability to cracking on repeated impact may worsen.

The sphere (intermediate layer-encased sphere) in which the core is encased with the intermediate layer has an initial velocity which is preferably at least 76.5 m/s, more preferably at least 77.0 m/s, and even more preferably at least 77.3 m/s. The upper limit is preferably not more than 78.5 m/s, more preferably not more than 78.0 m/s, and even more preferably not more than 77.7 m/s. If this initial velocity value is too high, the extent to which the distance with respect to the current tour ball is reduced on shots with a driver by long hitters is inadequate, and there is a possibility that the distance is too large compared with the standard distance of the new distance rules assumed by the R&A and the USGA. On the other hand, if the initial velocity is too low, a distance may not be attainable on shots with a driver (W #1) by average hitters and on shots with an iron. The value of the initial velocity in this case is the same as the device and conditions used in the measurement of the initial velocity of the core described above.

When the initial velocity of the intermediate layer-encased sphere is denoted by $V_M$(m/s), and the deflection is denoted by M (mm) when the intermediate layer-encased sphere is compressed under a final load of 1,275 N (130 kgf) from an initial load of 98 N (10 kgf), a value of $V_M/M$ is preferably at least 23, more preferably at least 25, and even more preferably at least 27. The upper limit is preferably not more than 36, more preferably not more than 34, and even more preferably not more than 32. If this value is too large, the extent to which the distance with respect to the current tour ball is reduced on shots with a driver by long hitters is inadequate, and there is a possibility that the distance is too large compared with the standard distance of the new distance rules assumed by the R&A and the USGA. On the other hand, if this value is too small, the distance on shots with a driver (W #1) by average hitters may become too small.

In addition, it is preferable to optimize a value (Miw) of [(initial velocity of intermediate layer-encased sphere−initial velocity of core)×(weight of intermediate layer-encased sphere−weight of core)], which is a relational expression of the initial velocity (m/s) of the core, the initial velocity (m/s) of the intermediate layer-encased sphere, the weight (g) of the core, and the weight (g) of the intermediate layer-encased sphere. This value means a value indicating a rebound of the intermediate layer material portion in relation to its parts by weight. The Miw value is preferably at least 2, more preferably at least 3, and even more preferably at least 4. The upper limit is preferably not more than 7. more preferably not more than 6, and even more preferably not more than 5. If this value is too large, the durability to repeated impact may worsen. On the other hand, if the value is too small, the spin rate of the ball on full shots may rise, so that a distance may not be attainable on shots with a driver (W #1) by average hitters and on shots with an iron.

Next, the cover is described.

The cover has a material hardness on the Shore C hardness scale which, although not particularly limited, is preferably at least 50, more preferably at least 57, and even more preferably at least 63. The upper limit is preferably not more than 86, more preferably not more than 74, and even more preferably not more than 71. The surface hardness on the Shore D hardness scale is preferably at least 30, more preferably at least 35, and even more preferably at least 40. The upper limit is preferably not more than 57, more preferably not more than 53, and even more preferably not more than 50.

The sphere obtained by encasing the intermediate layer-encased sphere with the cover—that is, the ball—has a surface hardness which, on the Shore C hardness scale, is preferably at least 73, more preferably at least 78 and even more preferably at least 83. The upper limit is preferably not more than 95, more preferably not more than 92, and even more preferably not more than 90. The surface hardness on the Shore D hardness scale is preferably at least 50, more preferably at least 53, and even more preferably at least 56. The upper limit is preferably not more than 70, more preferably not more than 65, and even more preferably not more than 61.

If the material hardness and the surface hardness of the cover are too soft in comparison with the above ranges, the spin rate may rise on full shots, so that the distance on shots with a driver (W #1) by average hitters and an iron may not be increased. On the other hand, if the material hardness and the surface hardness of the cover are too hard in comparison with the above ranges, the ball may not be fully receptive to spin on approach shots, or a scuff resistance may worsen.

The cover has a thickness of preferably at least 0.3 mm, more preferably at least 0.5 mm, and even more preferably at least 0.6 mm. The upper limit in the cover thickness is preferably not more than 1.2 mm, more preferably not more than 0.9 mm, and even more preferably not more than 0.8 mm. If the cover is too thick, the rebound of the ball on full shots is inadequate or the spin rate may rise, and accordingly the distance on shots with a driver (W #1) by average hitters and on shots with an iron by both average hitters and long hitters may not be increased. On the other hand, when the cover is too thin, the scuff resistance may worsen or the ball may not be receptive to spin on approach shots and may thus lack sufficient controllability.

As the cover material, various urethane resins used as a cover material in golf balls may be used from the viewpoints of spin controllability and scuff resistance in the short game. Furthermore, from the viewpoint of mass productivity, it is preferable to use a resin material mainly composed of a thermoplastic polyurethane. Further, the cover is suitably formed of a resin blend containing (I) a thermoplastic polyurethane and (II) a polyisocyanate compound as principal components.

The total weight of the components (I) and (II) is recommended to be at least 60%, and more preferably at least 70% with respect to the total amount of the resin composition of the cover. The components (I) and (II) are described in detail below.

Describing the thermoplastic polyurethane (I), the construction of the thermoplastic polyurethane includes a soft segment composed of a polymeric polyol (polymeric glycol), which is a long-chain polyol, and a hard segment composed of a chain extender and a polyisocyanate compound. Here, as the long-chain polyol serving as a starting material, any of those hitherto used in the art related to thermoplastic polyurethane can be used, and are not particularly limited, and examples thereof can include polyester polyol, polyether polyol, polycarbonate polyol, polyester polycarbonate polyol, polyolefin polyol, conjugated diene polymer-based polyol, castor oil-based polyol, silicone-based polyol, and vinyl polymer-based polyol. These long-chain polyols may be used singly, or two or more may be used in combination. Among them, a polyether polyol is preferable from the viewpoint that a thermoplastic polyurethane having a high rebound resilience and excellent low-temperature properties can be synthesized.

As the chain extender, those hitherto used in the art related to thermoplastic polyurethanes can be suitably used, and for example, a low-molecular-weight compound having on the molecule two or more active hydrogen atoms capable of reacting with an isocyanate group and having a molecular weight of not more than 400 is preferable. Examples of the chain extender include, but are not limited to, 1,4-butylene glycol, 1.2-ethylene glycol, 1,3-butanediol, 1,6-hexanediol, 2,2-dimethyl-1,3-propanediol, or the like. Among them, the chain extender is preferably an aliphatic diol having from 2 to 12 carbon atoms, and is more preferably 1,4-butylene glycol.

As the polyisocyanate compound, those hitherto used in the art related to thermoplastic polyurethane can be suitably used, and are not particularly limited. Specifically, one or two or more selected from the group consisting of 4,4'-diphenylmethane diisocyanate, 2,4-toluene diisocyanate (or) 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, and dimer acid diisocyanate can be used. However, it may be difficult to control a crosslinking reaction during injection molding depending on the type of isocyanate. In the present invention, 4,4'-diphenylmethane diisocyanate, which is an aromatic diisocyanate, is most preferable from the viewpoint of providing a balance between stability during production and the physical properties to be manifested.

As specific examples of the thermoplastic polyurethane serving as the component (I), commercially available products can be used such as Pandex T-8295, Pandex T-8290, and Pandex T-8260 (all manufactured by DIC Covestro Polymer, Ltd.).

Although not an essential component, a thermoplastic elastomer other than the thermoplastic polyurethane can be included as a separate component (III) with the components (I) and (II). By including the component (III) in the resin blend, a flowability of the resin blend can be further improved, and various physical properties required of the golf ball cover material can be increased, such as rebound and scuff resistance.

A compositional ratio of the components (I), (II), and (III) is not particularly limited, but in order to sufficiently and effectively exhibit the advantageous effects of the present invention, the compositional ratio (I): (II): (III) is preferably in the weight ratio range of from 100:2:50 to 100:50:0, and more preferably from 100:2:50 to 100:30:8.

Furthermore, various additives other than the components constituting the thermoplastic polyurethane can be included in the resin blend as necessary, and for example, a pigment, a dispersant, an antioxidant, a light stabilizer, an ultraviolet absorber, an internal mold lubricant, or the like can be appropriately included.

The manufacture of a multi-piece solid golf ball in which the above-described core, intermediate layer, and cover (outermost layer) are formed as successive layers can be performed by a customary method such as a known injection molding process. For example, an intermediate layer material is injected around the core in an injection mold to obtain an intermediate layer-encased sphere, and finally, a cover material, which is the outermost layer, is injection molded to obtain a multi-piece golf ball. In addition, it is also possible to produce a golf ball by preparing two half-cups premolded into hemispherical shapes, enclosing the core and the intermediate layer-encased sphere within the two half cups, and molding the core and the intermediate layer-encased sphere under applied heat and pressure.

The golf ball has a deflection when compressed under a final load of 1,275 N (130 kgf) from an initial load of 98 N (10 kgf) which is preferably at least 2.0 mm, more preferably at least 2.2 mm, and even more preferably at least 2.3 mm. The deflection upper limit needs to be less than 2.7 mm, preferably not more than 2.6 mm, and more preferably not more than 2.5 mm. If the deflection of the golf ball is too small, that is, if the sphere is too hard, the spin rate of the ball rises and the distance on shots with a driver (W #1) by average hitters and on shots with an iron may not be increased, or the feel at impact may be too hard. On the other hand, if the deflection is too large, that is, if the sphere is too soft, the spin rate decreases and a run increases too much on shots with an iron, it may be difficult to control the desired distance, the feel at impact may be too soft, or the durability to cracking on repeated impact may worsen.

The initial velocity of the sphere (ball) in which the intermediate layer-encased sphere is encased with the cover is preferably at least 76.5 m/s, more preferably at least 76.7 m/s, and even more preferably at least 76.9 m/s. The upper limit is not more than 77.724 m/s. If this initial velocity value is too high, the official rules of R&A and USGA are not satisfied. On the other hand, if the initial velocity is too low, a distance may not be attainable on shots with a driver (W #1) by average hitters and on shots with an iron. The initial velocity value in this case is measured with the same device and under the same conditions as described above for measurement of the initial velocities of the core and the intermediate layer-encased sphere.

When the initial velocity of the ball is denoted by V (m/s), and the deflection (mm) is denoted by B (mm) when the ball is compressed under a final load of 1,275 N (130 kgf) from an initial load of 98 N (10 kgf), the value of V/B is preferably at least 27, more preferably at least 29, and even more preferably at least 31. The upper limit is preferably not more than 35, more preferably not more than 34, and even more preferably not more than 33. If this value is too large, the extent to which the distance with respect to the current tour ball is reduced on shots with a driver by long hitters is inadequate, and there is a possibility that the distance is too large compared with the standard distance of the new distance rules assumed by the R&A and the USGA. On the other hand, if this value is too small, the distance on shots with a driver (W #1) by average hitters may become too small.

In addition, it is preferable to optimize the value (CViw) of [(initial velocity of ball −initial velocity of intermediate layer-encased sphere)×(weight of ball−weight of intermediate layer-encased sphere)], which is a relational expression of the initial velocity (m/s) of the intermediate layer-encased sphere, the initial velocity (m/s) of the ball, the weight (g) of the intermediate layer-encased sphere, and the weight (g) of the ball. This value means a value indicating a rebound of the cover material portion in relation to its parts by weight. The value of CViw is preferably at least −5, more preferably at least −4, and even more preferably at least −3. The upper limit is preferably not more than 0, more preferably not more than −1, and even more preferably not more than −2. If this value is too large, the controllability during a short game may be insufficient. On the other hand, if this value is too small, the spin rate on full shots may rise, the rebound of the ball becomes too low, and the distance on shots with a driver (W #1) by average hitters and on shots with an iron may become too small.

Relationships Between Surface Hardnesses of Each Sphere

In the present invention, from the viewpoint that a relationship between the surface hardness of the intermediate layer-encased sphere and the surface hardness of ball is compatible with a superior distance on shots with a driver (W #1) by average hitters and on full shots with an iron and controllability in the short game, the following condition needs to be satisfied:

(surface hardness of ball)<(surface hardness of intermediate layer-encased sphere). Expressed on the Shore C hardness scale, a value obtained by subtracting the surface hardness of the ball from the surface hardness of the intermediate layer-encased sphere is preferably larger than 0, more preferably at least 4, and even more preferably at least 7. The upper limit is preferably not more than 20, more preferably not more than 16, and even more preferably not more than 12. When the above value is not more than 0, it may be difficult to achieve both the superior distance on shots with a driver by average hitters and on full shots with an iron and controllability in the short game. On the other hand, if the value is too large, the distance made on shots with a driver (W #1) by average hitters and on shots with an iron may be shorter than the intended distance.

Expressed on the Shore C hardness scale, a value obtained by subtracting the core surface hardness from the surface hardness of the intermediate layer-encased sphere is preferably at least 5, more preferably at least 7, and even more preferably at least 9, and an upper limit thereof is preferably not more than 20, more preferably not more than 17, and even more preferably not more than 14. If the value deviates from the above ranges, the spin rate of the ball on full shots may rise, so that a desired distance may not be attainable on shots with a driver (W #1) by average hitters and on shots with an iron.

Expressed on the Shore C hardness scale, a value obtained by subtracting the core center hardness from the surface hardness of the intermediate layer-encased sphere is preferably at least 27, more preferably at least 30, and even more preferably at least 33, and an upper limit thereof is preferably not more than 43, more preferably not more than 40, and even more preferably not more than 37. If the value is too small, the spin rate of the ball on full shots may rise, so that a desired distance may not be attainable on shots with a driver (W #1) by average hitters and on shots with an iron. On the other hand, if the above value is too large, the durability to cracking on repeated impact may worsen, the actual initial velocity on shots becomes lower, a desired distance may not be attainable on shots with a driver (W #1) by average hitters. In addition, a run on shots with an iron may increase, which may fail to satisfy the needs of professionals or advanced players.

Core Diameter and Ball Diameter

A relationship between the core diameter and the ball diameter, that is, a value of (core diameter)/(ball diameter) is preferably at least 0.878, more preferably at least 0.890, and even more preferably at least 0.899. An upper limit thereof is preferably not more than 0.937, more preferably not more than 0.923, and even more preferably not more than 0.909. If this value is too small, the initial velocity of the ball may become too low, or a deflection of the entire ball may become small and the ball becomes too hard, so that the spin rate of the ball on full shots may rise, and the distance on shots with a driver (W #1) by average hitters and on shots with an iron may be shorter than the intended distance. On the other hand, if the value is too large, the spin rate of the ball on full shots may rise, the distance on shots with a driver (W #1) by average hitters and on shots with an iron may be shorter than the intended distance, or the durability to cracking on repeated impact may worsen.

Relationships Between Deflections of Each Sphere

When each sphere of the core and the ball is compressed under a final load of 1,275 N (130 kgf) from an initial load of 98 N (10 kgf) and the deflections (mm) are denoted by B (mm) and C (mm), respectively, a value of C−B is preferably at least 0.30 mm, more preferably at least 0.40 mm, and even more preferably at least 0.50 mm. The upper limit is preferably not more than 0.90 mm, more preferably not more than 0.80 mm, and even more preferably not more than 0.70 mm. If the above value is too large, the durability to cracking on repeated impact may worsen, the actual initial velocity on shots becomes lower, and a desired distance may not be attainable on shots with a driver (W #1) by average hitters, a run on shots with an iron may increase too much. On the other hand, if this value is too small, the feel at impact may be too hard, the spin rate of the ball on full shots may rise, so that a desired distance may not be attainable on shots with a driver (W #1) by average hitters and on shots with an iron.

When each sphere of the core and the intermediate layer-encased sphere is compressed under a final load of 1.275 N (130 kgf) from an initial load of 98 N (10 kgf) and the deflections (mm) are denoted by C (mm) and M (mm), respectively, a value of C−M is preferably at least 0.30 mm, more preferably at least 0.35 mm, and even more preferably at least 0.40 mm. The upper limit is preferably not more than 0.65 mm, more preferably not more than 0.60 mm, and even more preferably not more than 0.55 mm. If the above value is too large, the durability to cracking on repeated impact may worsen, the actual initial velocity on shots becomes lower, and a desired distance may not be attainable on shots with a driver (W #1) by average hitters. On the other hand, if this value is too small, the feel at impact may be too hard, the spin rate of the ball on full shots may rise, so that a desired distance may not be attainable on shots with a driver (W #1) by average hitters and on shots with an iron.

Value of $Ciw+Miw+CViw$

In the golf ball of the present invention, when a value of (initial velocity of core×weight of core) is denoted by Ciw, a value of [(initial velocity of intermediate layer-encased sphere−initial velocity of core)×(weight of intermediate layer-encased sphere−weight of core)] is denoted by Miw, and a value of [(initial velocity of ball−initial velocity of intermediate layer-encased sphere)×(weight of ball−weight of intermediate layer-encased sphere)] is denoted by CViw, the following expression needs to be satisfied:

$$2600 \leq Ciw+Miw+CViw \leq 2715.$$

Ciw+Miw+CViw means a sum of the values indicating the rebound of each of the core, the intermediate layer material, and the cover material portion in relation to their parts by weight, and by designing the golf ball so as to satisfy the above expression, while reducing the distance on shots with a driver (W #1) by long hitters, it is possible to make the distance for reducing the distance on shots with a driver (W #1) or a long iron by average hitters smaller as compared with the distance for reducing the distance on shots by long hitters. The lower limit of Ciw+Miw+CViw is at least 2,600, preferably at least 2,630, and more preferably at least 2,660. The upper limit is not more than 2,715 preferably not more than 2,705, and more preferably not more than 2,695. If this value is too large, the distance in shot conditions with a driver (W #1) by long hitters may be too large, or a desired distance may not be attainable on shots with a driver (W #1) by average hitters and with an iron. On the other hand, if the value is too small, a desired distance may not be attainable on shots with a driver (W #1) by average hitters or on shots with an iron.

Numerous dimples may be formed on the outside surface of the cover. Although not particularly limited, the number of dimples arranged on the surface of the cover is preferably at least 280, preferably at least 300, and more preferably at least 310, and the upper limit thereof can be preferably not more than 450, more preferably not more than 400, and even more preferably not more than 350. If the number of dimples deviates from the above range, the distance on shots with a driver (W #1) by average hitters may be lowered.

As for the shape of the dimples, one type or a combination of two or more types such as a circular shape, various polygonal shapes, a dewdrop shape, and other oval shapes can be appropriately used. For example, if circular dimples are used, the diameter can be about at least 2.5 mm and not more than 6.5 mm, and the depth can be at least 0.08 mm and not more than 0.30 mm.

A dimple coverage ratio of the dimples on the spherical surface of the golf ball, specifically, a ratio (surface area coverage ratio, hereinafter, SR value) of a sum of the individual dimple surface areas, each defined by a flat plane circumscribed by an edge of a dimple, to a ball spherical surface area on the assumption that the ball has no dimples is preferable at least 75%, more preferably at least 80%, and even more preferably at least 84%. The upper limit is not more than 90%, more preferably not more than 88%, and even more preferably not more than 86%. If the SR value deviates from the above range, the distance on shots with a driver (W #1) by average hitters may be lowered.

A VR value of a sum of the volumes of the individual dimples, formed below the flat plane circumscribed by the edge of a dimple, to a ball spherical volume on the assumption that the ball has no dimples, is at least 0.77%, preferably at least 0.79%, more preferably at least 0.81%. The upper limit is not more than 0.92%, more preferably not more than 0.89%, more preferably not more than 0.86%. If this VR value is larger than the above range, there is a case where the distance on shots with a driver (W #1) by long hitters may be too small, or the intended distance on shots with a driver (W #1) by average hitters may not be attainable. In addition, in this case, a ball trajectory may become lower, it becomes difficult to carry, and it may become difficult to go over a valley or a pond. On the other hand, if the value is too small, the extent of reducing the distance on shots with a driver (W #1) by long hitters is inadequate, and there is a possibility that the distance is too large compared with the standard distance of the new distance rules assumed by the R&A and the USGA.

A value Vo obtained by dividing the spatial volume of the dimples below the flat plane circumscribed by the edge of each dimple by a volume of a cylinder whose base is the flat plane and whose height is a maximum depth of the dimple from the base is preferably at least 0.35, more preferably at least 0.38, and further preferably at least 0.40. The upper limit is not more than 0.80, more preferably not more than 0.70, and even more preferably not more than 0.60. If the Vo value deviates from the above range, the distance on shots with a driver (W #1) by long hitters and average hitters may be shorter than the intended distance.

In the golf ball of the present invention, when a ratio (CL1/CD1) of a lift coefficient CL1 at a Reynolds number of 218000 and a spin rate of 2800 rpm to a drag coefficient CD1 is denoted by A1, a ratio (CL2/CD2) of a lift coefficient CL2 at a Reynolds number of 184000 and a spin rate of 2900 rpm to a drag coefficient CD2 is denoted by A2, and a ratio (CL3/CD3) of a lift coefficient CL3 at a Reynolds number of 158000 and a spin rate of 3100 rpm to a drag coefficient CD3 is denoted by A3, the dimples are designed to satisfy the following two conditions:

$$0.590 \leq A1 \leq 0.655 \text{ and}$$

$$(A2+A3)/2 \geq 0.670.$$

In the present specification, the "lift coefficients (CL1, CL2, CL3), drag coefficients (CD1, CD2, CD3)" are measured in accordance with the Indoor Test Range (ITR) defined by the USGA (United States Golf Association). The lift coefficients and the drag coefficients can be adjusted by adjusting the configuration of the dimples of the golf ball (arrangement, diameter, depth, volume, number, shape, and the like). The lift coefficients and the drag coefficients are independent of the internal configuration of the golf ball. The Reynolds number (Re) is a dimensionless number used in the field of hydrodynamics. The Reynolds number (Re) is calculated by the following equation (1).

$$Re=\rho vL/\mu \quad (1)$$

In Equation (1) above, p represents the density of a fluid, v represents the average velocity of an object relative to the flow of the fluid, L represents a characteristic length, and μ represents the viscosity coefficient of the fluid.

In the present invention, when a ratio CL1/CD1 of a lift coefficient CL1 at a Reynolds number of 218000 and a spin rate of 2800 rpm to a drag coefficient CD1 is defined as A1, a ratio CL2/CD2 of a lift coefficient CL2 at a Reynolds number of 184000 and a spin rate of 2900 rpm to a drag coefficient CD2 is defined as A2, and a ratio CL3/CD3 of a lift coefficient CL3 at a Reynolds number of 158000 and a spin rate of 3100 rpm to a drag coefficient CD3 is defined as A3.

The condition under which the lift coefficient CL1 and the drag coefficient CD1 are measured is described, that is, Reynolds number 218000 and spin rate 2800 rpm. This high-speed condition corresponds to a condition provided by a long hitter with a driver (W #1), this Reynolds number corresponds to a ball speed when a golf ball is driven out at a head speed (HS) of 54 m/s, and the spin rate 2800 rpm is an average spin condition of a player with a head speed (HS) of 54 m/s.

The condition under which the lift coefficient CL2 and the drag coefficient CD2 are measured is described, that is, Reynolds number 184000 and spin rate 2900 rpm. This middle-speed condition corresponds to a condition provided by an average hitter with a driver (W #1) at a head speed (HS) of 45 m/s, this Reynolds number corresponds to a ball speed when a golf ball is driven out at a head speed (HS) of 45 m/s, and the spin rate 2900 rpm is an average spin condition of a player with a head speed (HS) of 45 m/s.

The condition under which the lift coefficient CL3 and the drag coefficient CD3 are measured is described, that is, Reynolds number 158000 and spin rate 3100 rpm. This low-speed condition corresponds to a condition provided by an average hitter with a driver (W #1) at a head speed (HS) of 40 m/s, this Reynolds number corresponds to a ball speed when a golf ball is driven out at a head speed (HS) of 40 m/s, and the spin rate 3100 rpm is an average spin condition of a player with a head speed (HS) of 40 m/s.

The ratio between the lift coefficient CL1 and the drag coefficient CD1, that is, the value of CL1/CD1=A1 is at least 0.590, preferably at least 0.595, and more preferably at least 0.600, and an upper limit thereof is not more than 0.655, preferably not more than 0.640, and more preferably not more than 0.627. If this value is too large, the effect of reducing the distance made by a long hitter with a driver (W #1) is insufficient, and the distance may be too large. On the other hand, if the above value is too small, the actual distance may be lower than the intended distance.

The ratio between the lift coefficient CL2 and the drag coefficient CD2, that is, the value of CL2/CD2=A2 is at least 0.635, preferably at least 0.645, and more preferably at least 0.660, and an upper limit thereof is not more than 0.750, preferably not more than 0.740, and more preferably not more than 0.730. If this value is too low, it becomes difficult to carry when hit with a driver (W #1) at a head speed (HS) of 45 m/s, and the intended total distance may not be obtained. On the other hand, if the above value is too high, the ball trajectory is blown up when hit with a driver (W #1) at a head speed (HS) of 45 m/s, and the intended distance may not be obtained.

The ratio between the lift coefficient CL3 and the drag coefficient CD3, that is, the value of CL3/CD3=A3 is at least 0.695, preferably at least 0.710, and more preferably at least 0.722, and an upper limit thereof is not more than 0.815, preferably not more than 0.810, and more preferably not more than 0.800. If this value is too low, it becomes difficult to carry when hit with a driver (W #1) at a head speed (HS) of 40 m/s, and the intended total distance may not be obtained. On the other hand, if the above value is too high, the ball trajectory is blown up when hit with a driver (W #1) at a head speed (HS) of 40 m/s, and the intended distance may not be obtained.

The average value of the above A2 and A3, that is, the value of (A2+A3)/2 is at least 0.670, preferably at least 0.680, and more preferably at least 0.690, and an upper limit thereof is preferably not more than 0.783, more preferably not more than 0.775, and even more preferably not more than 0.765. If this value is too low, it becomes difficult to carry when hit by an average hitter with a driver (W #1), and the intended total distance may not be obtained. On the other hand, if the above value is too high, the ball trajectory is blown up when hit by an average hitter with a driver (W #1), and the intended distance may not be obtained.

The multi-piece solid golf ball of the present invention can be made to conform to the Rules of Golf for play. The inventive ball may be formed to a diameter which is such that the ball does not pass through a ring having an inner diameter of 42.672 mm and to a weight which is preferably between 45.0 and 45.93 g.

EXAMPLES

Hereinafter, the present invention is specifically described with reference to Examples and Comparative Examples, but the present invention is not limited to the following Examples.

Example 1 to 3 and Comparative Examples 1 to 10

Formation of Core

In Example 1 and Comparative Examples 1, 3 to 5, and 7 to 9, a rubber composition of each Example shown in Table 1 was prepared, and then vulcanization molding was performed under vulcanization conditions according to each Example shown in Table 1 to produce a solid core.

In Examples 2 and 3 and Comparative Examples 2, 6, and 10, cores are produced based on the formulations in Table 1 in the same manner as described above.

TABLE 1

| Core formulation | Example | | | Comparative Example | | | | | | | | | |
|---|---|---|---|---|---|---|---|---|---|---|---|---|---|
| (pbw) | 1 | 2 | 3 | 1 | 2 | 3 | 4 | 5 | 6 | 7 | 8 | 9 | 10 |
| Polybutadiene A | 100 | 100 | 100 | 100 | 100 | | | 35 | 35 | 64 | 64 | 64 | 95 |
| Polybutadiene B | | | | | | 20 | 20 | | | | | | |
| Polybutadiene C | | | | | | 80 | 80 | | | | | | |

TABLE 1-continued

| Core formulation | | Example | | | Comparative Example | | | | | | | | | |
|---|---|---|---|---|---|---|---|---|---|---|---|---|---|---|
| (pbw) | | 1 | 2 | 3 | 1 | 2 | 3 | 4 | 5 | 6 | 7 | 8 | 9 | 10 |
| Isoprene rubber | | | | | | | | | | | | | | 5 |
| Styrene-butadiene rubber | | | | | | | | | 65 | 65 | 36 | 36 | 36 | |
| Zinc acrylate | | 37.0 | 37.0 | 35.0 | 37.0 | 37.0 | 33.5 | 33.5 | 26.9 | 26.9 | 31.0 | 29.0 | 27.0 | |
| Zinc methacrylate | | 1.0 | 1.0 | 1.0 | 1.0 | 1.0 | | | 1.0 | 1.0 | | | | |
| Methacrylic acid | | | | | | | | | | | | | | 23.5 |
| Zinc stearate | | | | | | | 2.0 | 2.0 | | | | | | |
| Organic peroxide | | 1.0 | 1.0 | 1.0 | 1.0 | 1.0 | 1.0 | 1.0 | 1.0 | 1.0 | 0.6 | 0.6 | 0.6 | 1.2 |
| Sulfur | | | | | | | 0.025 | 0.025 | | | | | | |
| Water | | 0.4 | 0.4 | 0.4 | 0.4 | 0.4 | 0.6 | 0.6 | 0.4 | 0.4 | 0.8 | 0.8 | 0.8 | |
| Antioxidant | | 0.1 | 0.1 | 0.1 | 0.1 | 0.1 | 0.1 | 0.1 | 0.1 | 0.1 | 0.1 | 0.1 | 0.1 | 0.2 |
| Zinc oxide | | 14.8 | 14.8 | 15.6 | 14.8 | 14.8 | 19.3 | 19.3 | 16.5 | 16.5 | 19.0 | 19.9 | 20.7 | 23.5 |
| Barium sulfate | | | | | | | | | | | | | | 1.0 |
| Zinc salt of pentachlorothiophenol | | 1.0 | 1.0 | 1.0 | 1.0 | 1.0 | 0.6 | 0.6 | | | | | | |
| Vulcanization conditions | Temp. (° C.) | 150 | 150 | 150 | 150 | 150 | 160 | 160 | 150 | 150 | 152 | 152 | 152 | 163 |
| | Time (min) | 19 | 19 | 19 | 19 | 19 | 14 | 14 | 19 | 19 | 19 | 19 | 19 | 21 |

Details of the above formulations are as follows.

Polybutadiene A: Trade name "BR01" (manufactured by JSR Corporation)

Polybutadiene B: Trade name "Diene 645" (FIRESTONE POLYMERS)

Polybutadiene C: Trade name "BUDENE 1224 G" (Goodyear Tire & Rubber Company)

Isoprene rubber: Trade name "IR 2200" (manufactured by JSR Corporation)

Styrene-butadiene rubber: Trade name "SBR 1507" (manufactured by JSR Corporation)

Zinc acrylate: Trade name "ZN-DA85S" (manufactured by Nippon Shokubai Co., Ltd.)

Zinc methacrylate: Trade name "ZDA-90" (manufactured by Asada Chemical Industry Co., Ltd.)

Zinc stearate: Trade name "BR-3T" (manufactured by Akrochem Corporation)

Organic peroxide: Dicumyl peroxide, trade name "Percumyl D" (manufactured by NOF Corporation)

Sulfur: Trade name "SANMIX S-80N" (manufactured by Sanshin Chemical Industry Co., Ltd., containing sulfur powder for rubber in an amount of 80 wt %)

Water: Pure water (manufactured by Seiki Co., Ltd.)

Antioxidant: 2,2-methylenebis(4-methyl-6-butylphenol), trade name "Nocrac NS-6" (manufactured by Ouchi Shinko Chemical Industrial Co., Ltd.)

Zinc oxide: Trade name "Grade 3 Zinc Oxide" (manufactured by Sakai Chemical Industry Co., Ltd.)

Zinc salt of pentachlorothiophenol: Manufactured by Wako Pure Chemical Industries, Ltd.

Formation of Intermediate Layer and Cover (Outermost Layer)

Next, in Example 1 and Comparative Examples 1, 3 to 5, and 7 to 9, the intermediate layer was formed by injection molding the resin material No. 1 or No. 2 of the intermediate layer shown in Table 2 around the core surface using an injection mold. Subsequently, the cover was formed by injection molding the resin material No. 3 of the cover (outermost layer) shown in Table 2 around the intermediate layer-encased sphere using a separate injection mold. At this time, a large number of predetermined dimples described below were formed on the cover surface.

In Examples 2 and 3 and Comparative Examples 2, 6, and 10, the intermediate layer is formed around the core surface by injection molding using the injection mold and the resin material No. 1 or No. 2 of the intermediate layer shown in Table 2. Subsequently, the cover is formed by injection molding the resin material No. 3 of the cover (outermost layer) shown in Table 2 around the intermediate layer-encased sphere using a separate injection mold. In Comparative Example 10, a cover is formed by injection molding a resin material No. 4 shown in Table 2 around the core surface using an injection molding mold. At this time, a large number of predetermined dimples described below are formed on the cover surface.

TABLE 2

| Resin material (parts by weight) | Acid content (wt %) | Metal type | No. 1 | No. 2 | No. 3 | No. 4 |
|---|---|---|---|---|---|---|
| Himilan 1605 | 15 | Na | 50 | | | |
| Himilan 1557 | 12 | Zn | 15 | | | |
| Himilan 1706 | 15 | Zn | 35 | 15 | | |
| AM7318 | 18 | Na | | 85 | | |
| Titanium oxide | | | | | 3 | 3 |
| Trimethylolpropane | | | 1.1 | 1.1 | | |
| TPU (1) | | | | | 100 | |
| TPU (2) | | | | | | 100 |

Details of the blending components in Table 2 are as follows.

"Himilan 1605", "Himilan 1557", "Himilan 1706", and "AM7318", ionomer resins manufactured by Dow-Mitsui Polychemicals Co., Ltd.

"Trimethylolpropane" (TMP) manufactured by Tokyo Chemical Industry Co., Ltd.

"Pandex" ether-type thermoplastic polyurethane (TPU (1)), material hardness (Shore D) 50, manufactured by DIC Covestro Polymer Ltd.

"Pandex" ether-type thermoplastic polyurethane (TPU (2)), material hardness (Shore D) 47, manufactured by DIC Covestro Polymer Ltd.

Figure 6A:
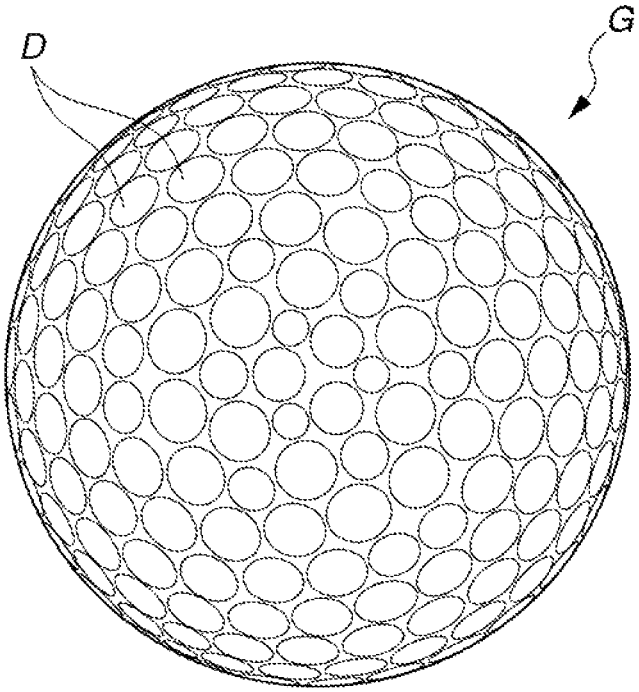
FIGS. 6A and 6B show an arrangement mode (pattern) of dimples (1) to (4) used in Examples 1 to 3 and Comparative Examples 1 to 9, where
Figure 6B:
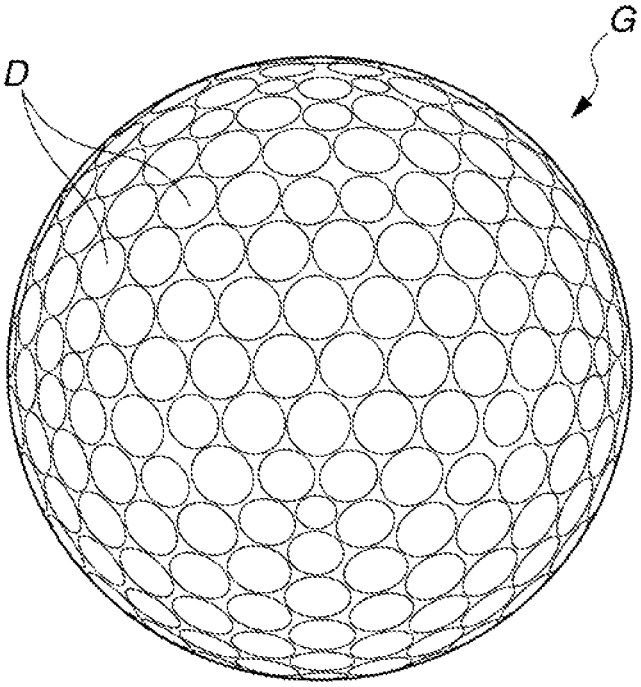
Figure 7A:
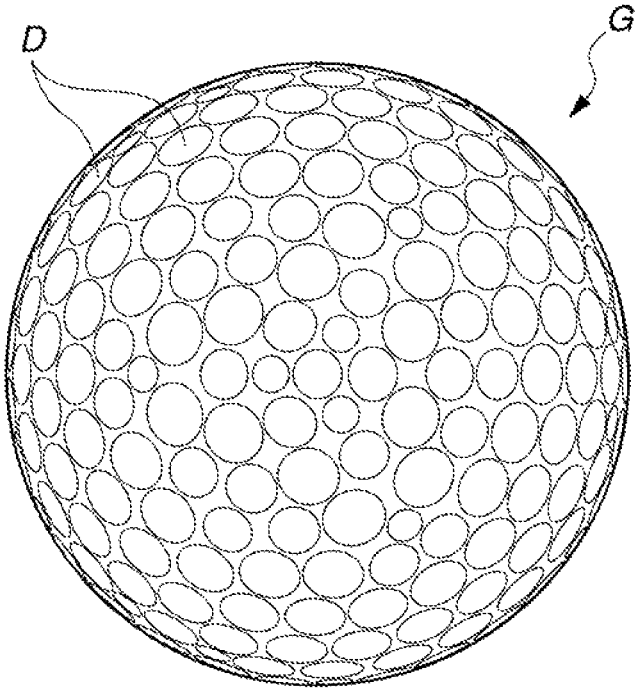
FIGS. 7A and 7B show an arrangement mode (pattern) of dimples (5) used in Comparative Example 10, where
Figure 7B:
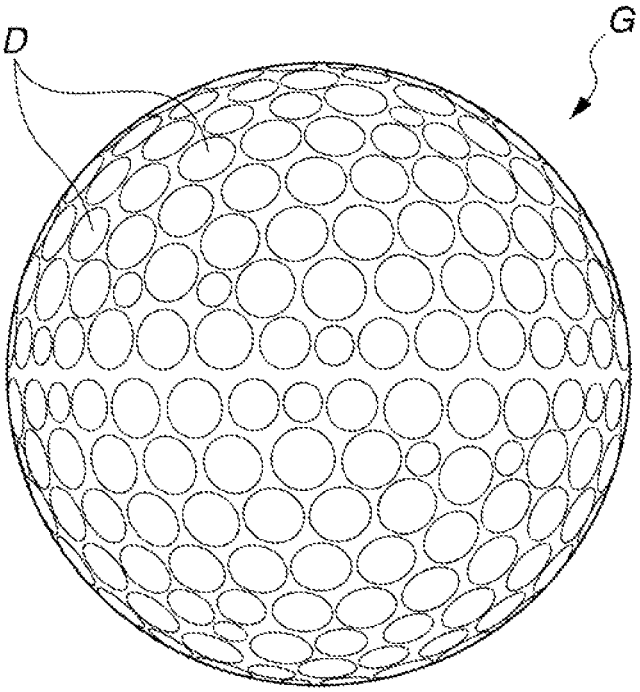

For the dimples of Examples and Comparative Examples, the following dimple (1) to (5) were used. Each dimple mode includes eight types of circular dimples of No. 1 to No. 8 having different diameters and depths. Details thereof are listed in Table 3 below. In addition, arrangement modes (patterns) of the dimples (1) to (4) are illustrated in FIGS. 6A and 6B. FIG. 6A is a plan view of the dimple, and FIG. 6B is a side view thereof. In addition, an arrangement mode (pattern) of the dimple (5) is illustrated in FIGS. 7A and 7B. FIG. 7A is a plan view of the dimple, and FIG. 7B is a side view thereof.

TABLE 3

| | Type | Quantity | Diameter (mm) | Depth (mm) | Volume ($mm^3$) | Cylindrical volume ratio Vo | SR (%) | VR (%) |
|---|---|---|---|---|---|---|---|---|
| Dimple (1) | No. 1 | 12 | 4.63 | 0.122 | 1.009 | 0.491 | 84 | 0.68 |
| | No. 2 | 198 | 4.50 | 0.119 | 0.919 | 0.486 | | |
| | No. 3 | 36 | 3.92 | 0.115 | 0.655 | 0.472 | | |
| | No. 4 | 12 | 2.87 | 0.086 | 0.245 | 0.442 | | |
| | No. 5 | 36 | 4.49 | 0.126 | 0.965 | 0.483 | | |
| | No. 6 | 24 | 3.92 | 0.124 | 0.711 | 0.473 | | |
| | No. 7 | 6 | 3.31 | 0.133 | 0.550 | 0.479 | | |
| | No. 8 | 6 | 3.21 | 0.132 | 0.457 | 0.430 | | |
| | Total | 330 | | | | | | |
| Dimple (2) | No. 1 | 12 | 4.69 | 0.144 | 1.220 | 0.493 | 86 | 0.81 |
| | No. 2 | 198 | 4.54 | 0.140 | 1.100 | 0.486 | | |
| | No. 3 | 36 | 3.96 | 0.134 | 0.766 | 0.467 | | |
| | No. 4 | 12 | 2.92 | 0.109 | 0.322 | 0.441 | | |
| | No. 5 | 36 | 4.54 | 0.146 | 1.141 | 0.485 | | |
| | No. 6 | 24 | 3.96 | 0.144 | 0.827 | 0.468 | | |
| | No. 7 | 6 | 3.36 | 0.136 | 0.590 | 0.491 | | |
| | No. 8 | 6 | 3.22 | 0.127 | 0.433 | 0.421 | | |
| | Total | 330 | | | | | | |
| Dimple (3) | No. 1 | 12 | 4.70 | 0.149 | 1.252 | 0.487 | 86 | 0.85 |
| | No. 2 | 198 | 4.55 | 0.146 | 1.144 | 0.483 | | |
| | No. 3 | 36 | 3.97 | 0.140 | 0.815 | 0.472 | | |
| | No. 4 | 12 | 2.91 | 0.103 | 0.298 | 0.435 | | |
| | No. 5 | 36 | 4.55 | 0.152 | 1.183 | 0.480 | | |
| | No. 6 | 24 | 3.97 | 0.150 | 0.864 | 0.467 | | |
| | No. 7 | 6 | 3.40 | 0.140 | 0.627 | 0.495 | | |
| | No. 8 | 6 | 3.33 | 0.138 | 0.510 | 0.426 | | |
| | Total | 330 | | | | | | |
| Dimple (4) | No. 1 | 12 | 4.68 | 0.164 | 1.391 | 0.493 | 85 | 0.83 |
| | No. 2 | 198 | 4.53 | 0.161 | 1.258 | 0.485 | | |
| | No. 3 | 36 | 3.95 | 0.154 | 0.883 | 0.468 | | |
| | No. 4 | 12 | 2.90 | 0.114 | 0.331 | 0.440 | | |
| | No. 5 | 36 | 4.53 | 0.168 | 1.294 | 0.480 | | |
| | No. 6 | 24 | 3.95 | 0.165 | 0.949 | 0.470 | | |
| | No. 7 | 6 | 3.36 | 0.154 | 0.663 | 0.487 | | |
| | No. 8 | 6 | 3.26 | 0.152 | 0.538 | 0.426 | | |
| | Total | 330 | | | | | | |
| Dimple (5) | No. 1 | 24 | 4.48 | 0.171 | 1.233 | 0.459 | 75 | 0.77 |
| | No. 2 | 174 | 4.29 | 0.164 | 1.073 | 0.452 | | |
| | No. 3 | 42 | 3.71 | 0.152 | 0.719 | 0.438 | | |
| | No. 4 | 12 | 2.87 | 0.121 | 0.327 | 0.419 | | |
| | No. 5 | 24 | 2.55 | 0.101 | 0.238 | 0.460 | | |
| | No. 6 | 30 | 4.33 | 0.179 | 1.160 | 0.440 | | |
| | No. 7 | 24 | 3.51 | 0.176 | 0.800 | 0.470 | | |
| | No. 8 | 8 | 3.30 | 0.145 | 0.520 | 0.418 | | |
| | Total | 338 | | | | | | |

Definition of Dimple

- Edge: highest point in cross section passing through center of a dimple
- Diameter: diameter of the flat plane circumscribed by the edge of a dimple Depth: maximum depth of a dimple from the flat plane circumscribed by the edge of the dimple
- SR: a ratio of a sum of the individual dimple surface areas, each defined by a flat plane circumscribed by an edge of a dimple, to a ball spherical surface area on the assumption that the ball has no dimples
- Dimple volume: a dimple volume under a flat plane circumscribed by an edge of a dimple
- Cylinder volume ratio: a ratio of the dimple volume to the cylinder volume having the same diameter as the dimple
- VR: a sum of the volumes of the individual dimples, formed below the flat plane circumscribed by the edge of a dimple, to a ball spherical volume on the assumption that the ball has no dimples The ratio CL1/CD1=A1 of the lift coefficient CL1 at a Reynolds number of 218000 and a spin rate of 2800 rpm to the drag coefficient CD1, the ratio CL2/CD2=A2 of the lift coefficient CL2 at a Reynolds number of 184000 and a spin rate of 2900 rpm to the drag coefficient CD2, and the ratio CL3/CD3=A3 of the lift coefficient CL3 at a Reynolds number of 158000 and a spin rate of 3100 rpm to the drag coefficient CD3 of the balls with the above dimples (1) to (5) formed on their cover surfaces are listed in the table below. These lift coefficients and drag coefficients are measured in accordance with the Indoor Test Range (ITR) defined by USGA.

TABLE 4

| | Dimple (1) | Dimple (2) | Dimple (3) | Dimple (4) |
|---|---|---|---|---|
| CL1 | 0.151 | 0.147 | 0.145 | 0.143 |
| CD1 | 0.230 | 0.237 | 0.239 | 0.244 |
| CL1/CD1 = A1 | 0.657 | 0.620 | 0.607 | 0.586 |

TABLE 4-continued

| | Dimple (1) | Dimple (2) | Dimple (3) | Dimple (4) |
|---|---|---|---|---|
| CL2 | 0.168 | 0.162 | 0.160 | 0.156 |
| CD2 | 0.233 | 0.240 | 0.242 | 0.246 |
| CL2/CD2 = A2 | 0.721 | 0.675 | 0.661 | 0.634 |
| CL3 | 0.190 | 0.182 | 0.179 | 0.173 |
| CD3 | 0.242 | 0.245 | 0.247 | 0.250 |
| CL3/CD3 = A3 | 0.785 | 0.743 | 0.725 | 0.692 |

*No data for Dimple (5)

For each resulting golf ball, various physical properties such as internal hardnesses at various positions of the core, outer diameters of the core and each layer-encased sphere, thicknesses and material hardnesses of each layer, surface hardnesses of each layer-encased sphere, and initial velocities of each layer-encased sphere are evaluated by the following methods, and are shown in Tables 5 to 8.

Core Hardness Profile

The core surface is spherical, but an indenter of a durometer is set substantially perpendicular to the spherical core surface, and a core surface hardness expressed on the Shore C hardness scale is measured in accordance with ASTM D2240. With respect to the core center and a predetermined position of the core, the core is cut into hemispheres to obtain a flat cross-section, the hardness is measured by perpendicularly pressing the indenter of the durometer against the center portion and the predetermined positions shown in Table 3, and the hardness at the center and each position are shown as Shore C hardness values. For the measurement of the hardness, a P2 Automatic Rubber Hardness Tester manufactured by Kobunshi Keiki Co., Ltd. equipped with a Shore C durometer is used. For the hardness value, a maximum value is read. All measurements are carried out in an environment of 23±2° ° C. Note that the numerical values in the table are Shore C hardness values.

In addition, in the core hardness profile, letting Cc be the Shore C hardness at the core center, $C_m$ be the Shore C hardness at the midpoint M between the core center and the core surface, Cm−2, Cm−4, and Cm−6 be respective Shore C hardnesses at positions 2 mm, 4 mm, and 6 mm inward from the midpoint M, Cm+2, Cm+4, and Cm+6 be respective Shore C hardnesses at positions 2 mm, 4 mm, and 6 mm outward from the midpoint M, and Cs be the Shore C hardness at the core surface, the surface areas A to F are calculated as follows:

surface area *A*: $\frac{1}{2}\times 2\times(Cm-4-Cm-6)$ surface area *B*: $\frac{1}{2}\times 2\times(Cm-2-Cm-4)$ surface area *C*: $\frac{1}{2}\times 2\times(Cm-Cm-2)$ surface area *D*: $\frac{1}{2}\times 2\times(Cm+2-Cm)$ surface area *E*: $\frac{1}{2}\times 2\times(Cm+4-Cm+2)$ surface area *F*: $\frac{1}{2}\times 2\times(Cm+6-Cm+4)$ and the values of the following four expressions *are* determined.

$$\text{Surface area } A + \text{Surface area } B \quad (1)$$

$$\text{Surface area } D + \text{Surface area } E \quad (2)$$

$$(\text{Surface area } D + \text{Surface area } E) - (\text{Surface area } A + \text{Surface area } B) \quad (3)$$

$$\{(\text{Surface area } D + \text{surface area } E) - (\text{Surface area } A + \text{surface area } B)\} \times (Cs - Cc) \quad (4)$$

The surface areas A to F in the core hardness profile are described in FIG. 2, which shows a graph that illustrates surface areas A to F using the core hardness profile data from Example 1.

Figure 3:
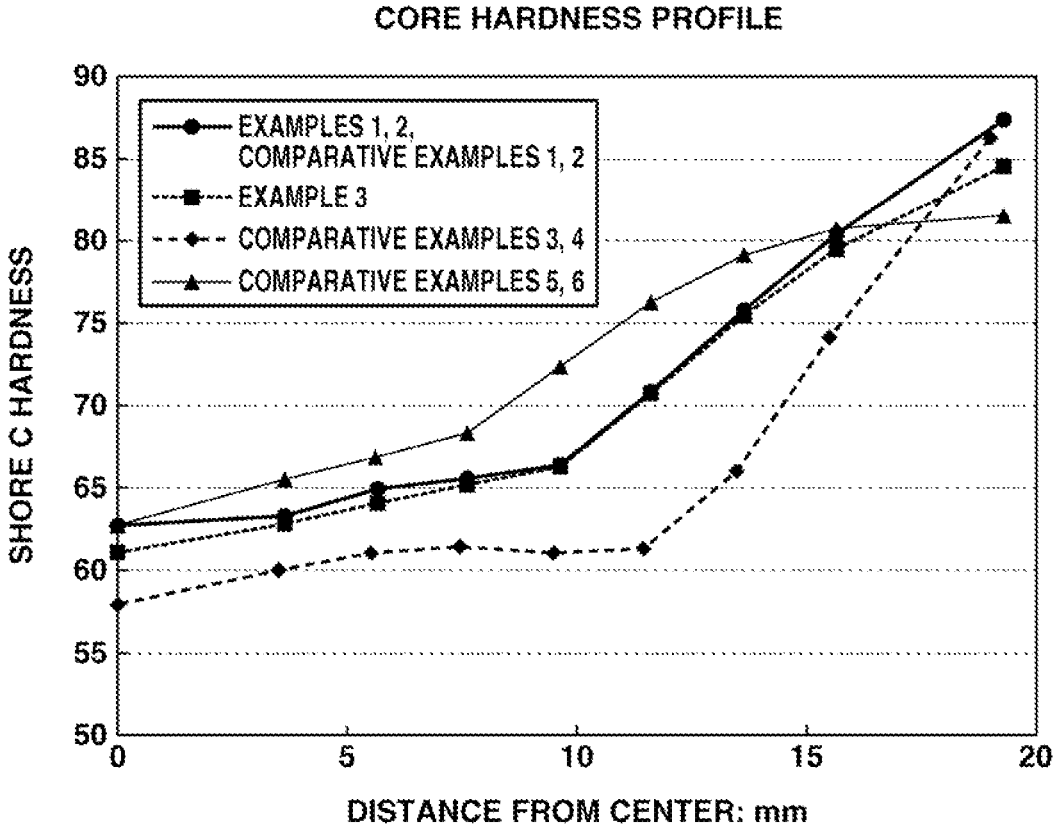
FIG. 3 is a graph showing the core hardness profiles in Examples 1 to 3 and Comparative Examples 1 to 6.
Figure 4:
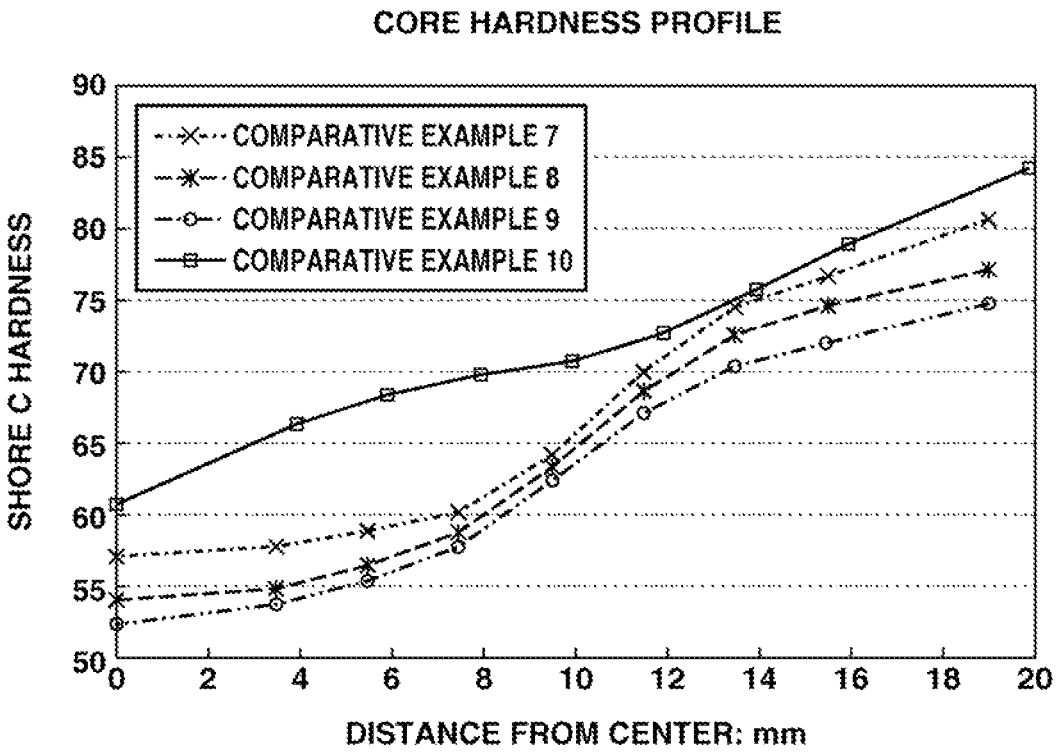
FIG. 4 is a graph showing the core hardness profiles in Comparative Examples 7 to FIG. 5 is a graph showing values of Ciw+Miw+CViw in Examples 1 to 3 and Comparative Examples 1 to 10.

In addition, FIGS. 3 and 4 show graphs of core hardness profiles for Examples 1 to 3 and Comparative Examples 1 to 10.

Diameters of Core and of Intermediate Layer-Encased Sphere

At a temperature adjusted to 23.9+1° C. for at least three hours or more in a thermostatic bath, five random places on the surface are measured in a room with a temperature of 23.9+2° C., and, using an average value of these measurements as a measured value of each sphere, an average value for the diameter of 10 such spheres is determined.

Ball Diameter

At a temperature adjusted to 23.9+1° C. for at least three hours or more in a thermostatic bath, a diameter at 15 random dimple-free places is measured in a room at a temperature of 23.9+2° C., and, using an average value of these measurements as a measured value of one ball, an average value for the diameter of 10 balls is determined.

Deflections of Core, Intermediate Layer-Encased Sphere, and Ball

Each subject layer-encased sphere is placed on a hard plate, and a deflection when compressed under a final load of 1.275 N (130 kgf) from an initial load of 98 N (10 kgf) is measured. Note that the deflection in each case is a measurement value measured in a room at a temperature of 23.9+2° C. after temperature adjustment to 23.9+1° C. for at least three hours in a thermostatic bath. As a measuring device, a high-load compression tester manufactured by MU Instruments Trading Corp. is used, and the down speed of the pressure head that compresses the core, the layer-encased sphere of each layer, or the ball is set to 10 mm/s.

Material Hardnesses of Intermediate Layer and Cover (Shore C and Shore D Hardnesses)

The resin material of each layer is molded into a sheet having a thickness of 2 mm and left at a temperature of 23+2° C. for two weeks. At the time of measurement, three such sheets are stacked together. The Shore C hardness and the Shore D hardness are each measured with a Shore C durometer and a Shore D durometer conforming to the ASTM D2240 standard. For the measurement of the hardness, the P2 Automatic Rubber Hardness Tester manufactured by Kobunshi Keiki Co., Ltd. to which a Shore C durometer or a Shore D durometer is mounted is used. For the hardness value, a maximum value is read. The measurement method is in accordance with the ASTM D2240 standard.

Surface Hardnesses of Intermediate Layer-Encased Sphere and of Ball

A measurement is performed by perpendicularly pressing the indenter against the surface of each sphere. Note that a surface hardness of a ball (cover) is a measured value at a dimple-free area (land) on the surface of the ball. The Shore C hardness and the Shore D hardness are each measured with a Shore C durometer and a Shore D durometer conforming to the ASTM D2240 standard. For the measurement of the hardness, the P2 Automatic Rubber Hardness Tester manufactured by Kobunshi Keiki Co., Ltd. to which a Shore C durometer or a Shore D durometer is mounted is used. For the hardness value, a maximum value is read. The measurement method is in accordance with the ASTM D2240 standard.

Initial Velocity of Each Sphere

The initial velocity of each sphere is measured at a temperature of 23.9+2° C. using the device for measuring COR manufactured by Hye Precision Products of the same type as the R&A. The measurement principle is as follows.

An air pressure is changed to four stages of 35.5 psi, 36.5 psi, 39.5 psi, and 40.5 psi, and a ball is fired at four stages of incident velocity by respective air pressures, collided with a barrier, and its COR is measured. That is, a correlation equation between the incident velocity and the COR is created by changing the air pressure in four stages. Similarly, a correlation equation between the incident velocity and a contact time is created.

Then, from these correlation equations, the COR and the contact time (μs) at an incident velocity of 43.83 m/s are determined and substituted into the following initial velocity conversion equation to calculate an initial velocity of each sphere.

$$IV=136.8+136.3e+0.019tc$$

[Here, e is a coefficient of restitution, and tc is a contact time (μs) at a collision speed of 143.8 ft/s (43.83 m/s).]

In the measurement of the initial velocity of each sphere, a barrel diameter is selected such that a clearance on one side with respect to an outer diameter of the object being measured is from 0.2 to 2.0 mm. For the core, a barrel diameter of 39.88 mm is selected in Examples 1 to 3 and Comparative Examples 1 to 9, and a barrel diameter of 41.53 mm is selected in Comparative Example 10. A barrel of 41.53 mm in all examples is selected for the intermediate layer-encased sphere, and a barrel of 43.18 mm in all examples is selected for the ball.

Values of *Ciw+Miw+CViw*

Figure 5:
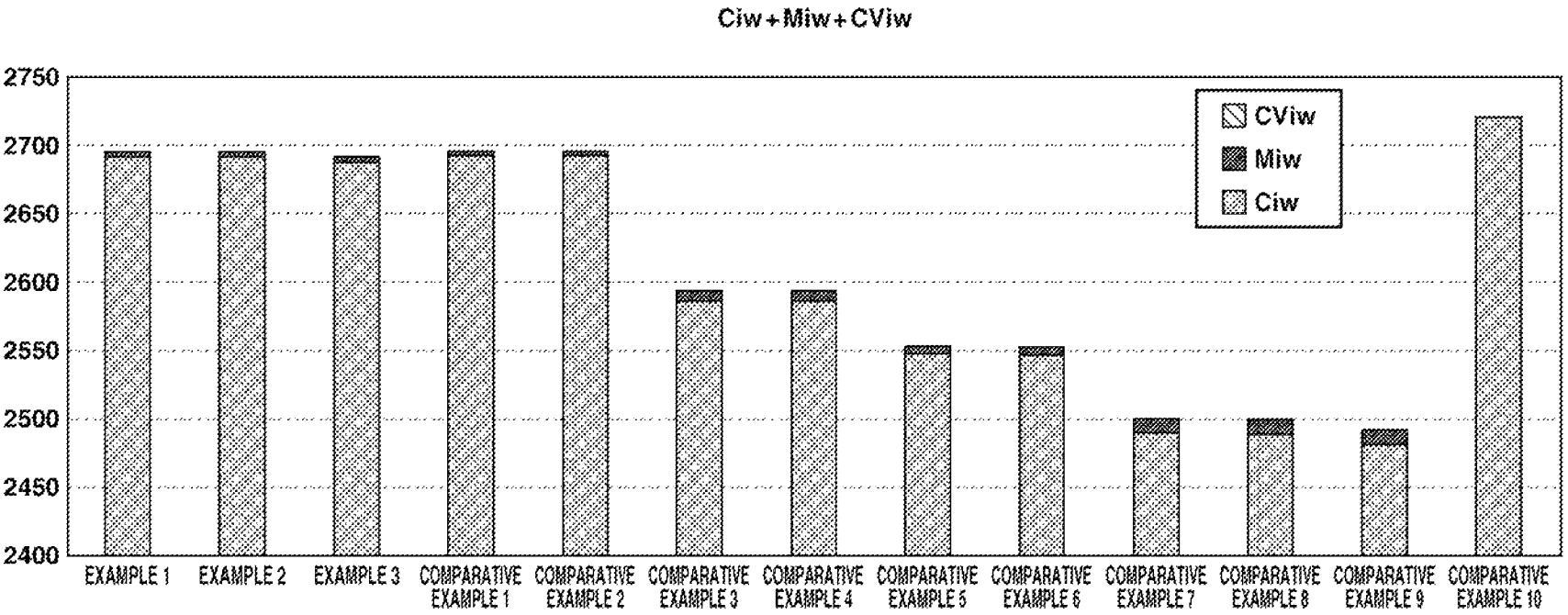

In each example of the Examples and the Comparative Examples, a value of Ciw+Miw+CViw is calculated by assuming that a value of (initial velocity of core×weight of core) is denoted by Ciw, a value of [(initial velocity of intermediate layer-encased sphere −initial velocity of core)×(weight of intermediate layer-encased sphere−weight of core)] is denoted by Miw, and a value of [(initial velocity of ball−initial velocity of intermediate layer-encased sphere)×(weight of ball−weight of intermediate layer-encased sphere)] is denoted by CViw. The numerical values of each example are shown in Tables 7 and 8, and a graph showing the values of Ciw+Miw+CViw is shown in FIG. 5.

TABLE 5

| | | Example | | | Comparative Example | | | |
|---|---|---|---|---|---|---|---|---|
| | | 1 | 2 | 3 | 1 | 2 | 3 | 4 |
| Structure (Piece) | | 3P | 3P | 3P | 3P | 3P | 3P | 3P |
| Core | Outer diameter (mm) | 38.65 | 38.65 | 38.65 | 38.65 | 38.65 | 38.06 | 38.06 |
| | Weight (g) | 35.09 | 35.09 | 35.09 | 35.09 | 35.09 | 33.83 | 33.83 |
| | Deflection C (mm) | 2.92 | 2.92 | 3.28 | 2.92 | 2.92 | 4.13 | 4.13 |
| | Initial velocity (m/s) | 76.70 | 76.70 | 76.58 | 76.70 | 76.70 | 76.44 | 76.44 |
| | Initial velocity/deflection | 26.3 | 26.3 | 23.3 | 26.3 | 26.3 | 18.5 | 18.5 |
| | Initial velocity × Weight: Ciw | 2,691 | 2,691 | 2,687 | 2,691 | 2,691 | 2,586 | 2,586 |
| | Ciw/C | 922 | 922 | 819 | 922 | 922 | 626 | 626 |
| | Cs (Shore C) | 87.4 | 87.4 | 84.6 | 87.4 | 87.4 | 86.3 | 86.3 |
| | Cm + 6 (Shore C) | 80.4 | 80.4 | 79.4 | 80.4 | 80.4 | 74.1 | 74.1 |
| | Cm + 4 (Shore C) | 75.8 | 75.8 | 75.4 | 75.8 | 75.8 | 65.9 | 65.9 |
| | Cm + 2 (Shore C) | 70.8 | 70.8 | 70.7 | 70.8 | 70.8 | 61.3 | 61.3 |
| | Cm (Shore C) | 66.3 | 66.3 | 66.3 | 66.3 | 66.3 | 61.0 | 61.0 |
| | Cm − 2 (Shore C) | 65.6 | 65.6 | 65.1 | 65.6 | 65.6 | 61.4 | 61.4 |
| | Cm − 4 (Shore C) | 64.9 | 64.9 | 64.0 | 64.9 | 64.9 | 61.0 | 61.0 |
| | Cm − 6 (Shore C) | 63.3 | 63.3 | 62.8 | 63.3 | 63.3 | 60.1 | 60.1 |
| | Cc (Shore C) | 62.6 | 62.6 | 61.0 | 62.6 | 62.6 | 57.9 | 57.9 |
| | Cs − Cc (Shore C) | 24.8 | 24.8 | 23.6 | 24.8 | 24.8 | 28.4 | 28.4 |
| | (Cs − Cc)/(Cm − Cc) | 6.7 | 6.7 | 4.5 | 6.7 | 6.7 | 9.2 | 9.2 |
| | Surface area A | 1.6 | 1.6 | 1.2 | 1.6 | 1.6 | 0.9 | 0.9 |
| | Surface area B | 0.7 | 0.7 | 1.1 | 0.7 | 0.7 | 0.4 | 0.4 |
| | Surface area C | 0.7 | 0.7 | 1.2 | 0.7 | 0.7 | -0.4 | -0.4 |
| | Surface area D | 4.5 | 4.5 | 4.4 | 4.5 | 4.5 | 0.3 | 0.3 |
| | Surface area E | 5.0 | 5.0 | 4.7 | 5.0 | 5.0 | 4.6 | 4.6 |
| | Surface area F | 4.6 | 4.6 | 4.0 | 4.6 | 4.6 | 8.2 | 8.2 |
| | Surface area A + surface area B | 2.3 | 2.3 | 2.3 | 2.3 | 2.3 | 1.3 | 1.3 |
| | Surface area D + surface area E | 9.5 | 9.5 | 9.1 | 9.5 | 9.5 | 4.9 | 4.9 |
| | (Surface areas: D + E) − (surface areas: A + B) | 7.2 | 7.2 | 6.8 | 7.2 | 7.2 | 3.6 | 3.6 |
| | {(Surface areas: D + E) − (surface areas: A + B)} × (Cs − Cc) | 179 | 179 | 160 | 179 | 179 | 102 | 102 |

TABLE 6

| | | Comparative Example | | | | | |
|---|---|---|---|---|---|---|---|
| | | 5 | 6 | 7 | 8 | 9 | 10 |
| Structure (Piece) | | 3P | 3P | 3P | 3P | 3P | 2P |
| Core | Outer diameter (mm) | 38.64 | 38.64 | 38.01 | 38.03 | 38.00 | 39.80 |
| | Weight (g) | 35.10 | 35.10 | 33.74 | 33.77 | 33.74 | 36.99 |
| | Deflection C (mm) | 2.93 | 2.93 | 3.78 | 4.04 | 4.33 | 2.63 |
| | Initial velocity (m/s) | 72.61 | 72.61 | 73.78 | 73.68 | 73.55 | 73.54 |
| | Initial velocity/deflection | 24.8 | 24.8 | 19.5 | 18.2 | 17.0 | 28.0 |
| | Initial velocity × Weight: Ciw | 2,549 | 2,549 | 2,489 | 2,488 | 2,482 | 2,720 |
| | Ciw/C | 870 | 870 | 659 | 616 | 573 | 1034 |
| | Cs (Shore C) | 81.5 | 81.5 | 80.7 | 77.2 | 74.8 | 84.3 |
| | Cm + 6 (Shore C) | 80.5 | 80.5 | 76.9 | 74.7 | 72.0 | 79.0 |
| | Cm + 4 (Shore C) | 79.0 | 79.0 | 74.5 | 72.6 | 70.4 | 75.9 |
| | Cm + 2 (Shore C) | 76.2 | 76.2 | 70.1 | 68.7 | 67.2 | 72.8 |
| | Cm (Shore C) | 72.3 | 72.3 | 64.3 | 63.4 | 62.5 | 70.8 |
| | Cm − 2 (Shore C) | 68.4 | 68.4 | 60.2 | 58.8 | 57.8 | 69.8 |
| | Cm − 4 (Shore C) | 66.9 | 66.9 | 59.0 | 56.4 | 55.4 | 68.4 |
| | Cm − 6 (Shore C) | 65.4 | 65.4 | 57.8 | 54.9 | 53.8 | 66.3 |
| | Cc (Shore C) | 62.7 | 62.7 | 57.1 | 54.0 | 52.4 | 60.7 |
| | Cs − Cc (Shore C) | 18.8 | 18.8 | 23.6 | 23.2 | 22.4 | 23.6 |
| | (Cs − Cc)/(Cm − Cc) | 2.0 | 2.0 | 3.3 | 2.5 | 2.2 | 2.3 |
| | Surface area A | 1.5 | 1.5 | 1.2 | 1.5 | 1.6 | 2.1 |
| | Surface area B | 1.5 | 1.5 | 1.2 | 2.4 | 2.4 | 1.4 |
| | Surface area C | 3.9 | 3.9 | 4.1 | 4.6 | 4.7 | 1.0 |
| | Surface area D | 3.9 | 3.9 | 5.8 | 5.3 | 4.7 | 2.0 |
| | Surface area E | 2.8 | 2.8 | 4.4 | 3.9 | 3.2 | 3.1 |
| | Surface area F | 1.5 | 1.5 | 2.4 | 2.1 | 1.6 | 3.1 |
| | Surface area A + surface area B | 3.0 | 3.0 | 2.4 | 3.9 | 4.0 | 3.5 |
| | Surface area D + surface area E | 6.7 | 6.7 | 10.2 | 9.2 | 7.9 | 5.1 |
| | (Surface areas: D + E) − (surface areas: A + B) | 3.7 | 3.7 | 7.8 | 5.3 | 3.9 | 1.6 |
| | {(Surface areas: D + E) − (surface areas: A + B)} × (Cs − Cc) | 70 | 70 | 184 | 123 | 87 | 38 |

TABLE 7

| | | Example | | | Comparative Example | | | |
|---|---|---|---|---|---|---|---|---|
| | | 1 | 2 | 3 | 1 | 2 | 3 | 4 |
| Intermediate layer | Material | No. 2 | No. 2 | No. 2 | No. 2 | No. 2 | No. 1 | No. 1 |
| | Thickness (mm) | 1.17 | 1.17 | 1.17 | 1.17 | 1.17 | 1.47 | 1.47 |
| | Weight (g) | 5.54 | 5.54 | 5.54 | 5.54 | 5.54 | 6.82 | 6.82 |
| | Material hardness (Shore C) | 94 | 94 | 94 | 94 | 94 | 94 | 94 |
| | Material hardness (Shore D) | 67 | 67 | 67 | 67 | 67 | 65 | 65 |
| Intermediate layer-encased sphere | Outer diameter (mm) | 40.99 | 40.99 | 40.99 | 40.99 | 40.99 | 41.00 | 41.00 |
| | Weight (g) | 40.63 | 40.63 | 40.63 | 40.63 | 40.63 | 40.65 | 40.65 |
| | Deflection (mm) | 2.45 | 2.45 | 2.83 | 2.45 | 2.45 | 3.20 | 3.20 |
| | Initial velocity (m/s) | 77.50 | 77.50 | 77.45 | 77.50 | 77.50 | 77.54 | 77.54 |
| | Initial velocity/deflection | 31.6 | 31.6 | 27.4 | 31.6 | 31.6 | 24.2 | 24.2 |
| | Surface hardness (Shore C) | 97 | 97 | 97 | 97 | 97 | 97 | 97 |
| | Surface hardness (Shore D) | 71 | 71 | 71 | 71 | 71 | 71 | 71 |
| (Initial velocity of intermediate layer-encased sphere − initial velocity of core) × (weight of intermediate layer-encased sphere − weight of core): Miw | | 4 | 4 | 5 | 4 | 4 | 8 | 8 |
| Surface hardness of intermediate layer − surface hardness of core (Shore C) | | 10 | 10 | 12 | 10 | 10 | 11 | 11 |
| Surface hardness of intermediate layer − center hardness of core (Shore C) | | 34 | 34 | 36 | 34 | 34 | 39 | 39 |
| Deflection of core − deflection of intermediate layer-encased sphere (mm) | | 0.47 | 0.47 | 0.45 | 0.47 | 0.47 | 0.93 | 0.93 |
| Cover | Material | No. 3 | No. 3 | No. 3 | No. 3 | No. 3 | No. 3 | No. 3 |
| | Thickness (mm) | 0.85 | 0.85 | 0.85 | 0.85 | 0.85 | 0.84 | 0.84 |
| | Material hardness (Shore C) | 71 | 71 | 71 | 71 | 71 | 71 | 71 |
| | Material hardness (Shore D) | 50 | 50 | 50 | 50 | 50 | 50 | 50 |
| Dimple | Type | (3) | (2) | (2) | (1) | (4) | (1) | (3) |
| | Quantity | 330 | 330 | 330 | 330 | 330 | 330 | 330 |
| | Surface area coverage ratio: SR (%) | 86 | 86 | 86 | 84 | 85 | 84 | 86 |
| | Volume occupancy ratio: VR (%) | 0.85 | 0.81 | 0.81 | 0.68 | 0.93 | 0.68 | 0.85 |
| | A1: CL1/CD1 | 0.607 | 0.620 | 0.620 | 0.657 | 0.586 | 0.657 | 0.607 |

TABLE 7-continued

| | | Example | | | Comparative Example | | | |
|---|---|---|---|---|---|---|---|---|
| | | 1 | 2 | 3 | 1 | 2 | 3 | 4 |
| | A2: CL2/CD2 | 0.661 | 0.675 | 0.675 | 0.721 | 0.634 | 0.721 | 0.661 |
| | A3: CL3/CD3 | 0.725 | 0.743 | 0.743 | 0.785 | 0.692 | 0.785 | 0.725 |
| | Average value of A2 and A3 | 0.693 | 0.709 | 0.709 | 0.753 | 0.663 | 0.753 | 0.693 |
| Ball | Outer diameter (mm) | 42.69 | 42.69 | 42.69 | 42.69 | 42.69 | 42.68 | 42.69 |
| | Weight (g) | 45.49 | 45.52 | 45.52 | 45.55 | 45.52 | 45.60 | 45.52 |
| | Deflection (mm) | 2.37 | 2.35 | 2.66 | 2.32 | 2.35 | 2.96 | 2.98 |
| | Initial velocity (m/s) | 76.99 | 77.08 | 77.08 | 77.17 | 77.08 | 76.91 | 76.96 |
| | Initial velocity/deflection | 32.5 | 32.9 | 32.9 | 33.3 | 32.8 | 26.0 | 25.8 |
| | Surface hardness (Shore C) | 87 | 87 | 87 | 87 | 87 | 86 | 86 |
| | Surface hardness (Shore D) | 61 | 61 | 61 | 61 | 61 | 60 | 60 |
| Weight of ball − weight of intermediate layer-encased sphere (g) | | 4.86 | 4.89 | 4.89 | 4.92 | 4.89 | 4.95 | 4.87 |
| (Initial velocity of ball − initial velocity of intermediate layer-encased sphere) × (weight of ball − weight of intermediate layer-encased sphere): CViw | | −2 | −2 | −2 | −2 | −2 | −3 | −3 |
| Ciw + Miw + CViw | | 2,693 | 2,694 | 2,690 | 2,694 | 2,694 | 2,590 | 2,591 |
| Surface hardness of intermediate layer − surface hardness of ball (Shore C) | | 10 | 10 | 10 | 10 | 10 | 11 | 11 |
| Deflection of core − deflection of ball (mm) | | 0.55 | 0.57 | 0.62 | 0.6 | 0.57 | 1.17 | 1.15 |
| Core diameter/ball diameter | | 0.905 | 0.905 | 0.905 | 0.905 | 0.905 | 0.892 | 0.892 |
| Intermediate layer thickness − cover thickness (mm) | | 0.32 | 0.32 | 0.32 | 0.32 | 0.32 | 0.63 | 0.63 |

TABLE 8

| | | Comparative Example | | | | | |
|---|---|---|---|---|---|---|---|
| | | 5 | 6 | 7 | 8 | 9 | 10 |
| Intermediate layer | Material | No. 2 | No. 2 | No. 1 | No. 1 | No. 1 | — |
| | Thickness (mm) | 1.21 | 1.21 | 1.52 | 1.52 | 1.52 | — |
| | Weight (g) | 5.71 | 5.71 | 7.02 | 7.00 | 7.00 | — |
| | Material hardness (Shore C) | 94 | 94 | 94 | 94 | 94 | — |
| | Material hardness (Shore D) | 67 | 67 | 65 | 65 | 65 | — |
| Intermediate layer-encased sphere | Outer diameter (mm) | 41.06 | 41.06 | 41.04 | 41.06 | 41.04 | — |
| | Weight (g) | 40.81 | 40.81 | 40.76 | 40.77 | 40.74 | — |
| | Deflection (mm) | 2.56 | 2.56 | 3.04 | 3.27 | 3.52 | — |
| | Initial velocity (m/s) | 73.38 | 73.38 | 75.36 | 75.20 | 75.17 | — |
| | Initial velocity/deflection | 28.7 | 28.7 | 24.8 | 23.0 | 21.4 | — |
| | Surface hardness (Shore C) | 97 | 97 | 97 | 97 | 97 | — |
| | Surface hardness (Shore D) | 71 | 71 | 71 | 71 | 71 | — |
| (Initial velocity of intermediate layer-encased sphere − initial velocity of core) × (weight of intermediate layer-encased sphere - weight of core): Miw | | 4 | 4 | 11 | 11 | 11 | — |
| Surface hardness of intermediate layer − surface hardness of core (Shore C) | | 16 | 16 | 16 | 20 | 22 | — |
| Surface hardness of intermediate layer − center hardness of core (Shore C) | | 34 | 34 | 40 | 43 | 45 | — |
| Deflection of core − deflection of intermediate layer-encased sphere (mm) | | 0.37 | 0.37 | 0.74 | 0.77 | 0.81 | — |
| Cover | Material | No. 3 | No. 3 | No. 3 | No. 3 | No. 3 | No. 4 |
| | Thickness (mm) | 0.81 | 0.81 | 0.82 | 0.81 | 0.82 | 1.46 |
| | Material hardness (Shore C) | 71 | 71 | 71 | 71 | 71 | 67 |
| | Material hardness (Shore D) | 50 | 50 | 50 | 50 | 50 | 47 |
| Dimple | Type | (1) | (3) | (1) | (1) | (1) | (5) |
| | Quantity | 330 | 330 | 330 | 330 | 330 | 338 |
| | Surface area coverage ratio: SR (%) | 84 | 86 | 84 | 84 | 84 | 75 |
| | Volume occupancy ratio: VR (%) | 0.68 | 0.85 | 0.68 | 0.68 | 0.68 | 0.77 |
| | A1: CL1/CD1 | 0.657 | 0.607 | 0.657 | 0.657 | 0.657 | No data |
| | A2: CL2/CD2 | 0.721 | 0.661 | 0.721 | 0.721 | 0.721 | |
| | A3: CL3/CD3 | 0.785 | 0.725 | 0.785 | 0.785 | 0.785 | |
| | Average value of A2 and A3 | 0.753 | 0.693 | 0.753 | 0.753 | 0.753 | |
| Ball | Outer diameter (mm) | 42.68 | 42.68 | 42.68 | 42.68 | 42.68 | 42.72 |
| | Weight (g) | 45.51 | 45.51 | 45.53 | 45.55 | 45.54 | 45.66 |
| | Deflection (mm) | 2.38 | 2.38 | 2.83 | 3.07 | 3.26 | 2.51 |
| | Initial velocity (m/s) | 73.06 | 73.06 | 74.91 | 74.84 | 74.84 | 73.36 |
| | Initial velocity/deflection | 30.7 | 30.7 | 26.5 | 24.4 | 23.0 | 29.2 |
| | Surface hardness (Shore C) | 87 | 87 | 86 | 86 | 86 | 79 |
| | Surface hardness (Shore D) | 61 | 61 | 60 | 60 | 60 | 53 |
| Weight of ball − weight of intermediate layer-encased sphere (g) | | 4.70 | 4.70 | 4.77 | 4.78 | 4.80 | 8.67 |
| (Initial velocity of ball − initial velocity of intermediate layer-encased sphere) × (weight of ball − weight of intermediate layer-encased sphere): CViw | | −2 | −2 | −2 | −2 | −2 | −2 |

TABLE 8-continued

| | Comparative Example | | | | | |
|---|---|---|---|---|---|---|
| | 5 | 6 | 7 | 8 | 9 | 10 |
| Ciw + Miw + CViw | 2,552 | 2,552 | 2,498 | 2,497 | 2,491 | 2,719 |
| Surface hardness of intermediate layer − surface hardness of ball (Shore C) | 10 | 10 | 11 | 11 | 11 | — |
| Deflection of core − deflection of ball (mm) | 0.55 | 0.55 | 0.95 | 0.97 | 1.07 | 0.12 |
| Core diameter/ball diameter | 0.905 | 0.905 | 0.891 | 0.891 | 0.890 | 0.932 |
| Intermediate layer thickness − cover thickness (mm) | 0.40 | 0.40 | 0.70 | 0.71 | 0.70 | — |

The flight (W #1 and I #6) and the controllability on approach shots of each golf ball are evaluated by the following methods. The results are shown in Table 9.

Evaluation of Flight (W #1, HS 54 m/s)

A driver is mounted on a golf swing robot, and a spin rate and a distance traveled (total) by a ball when struck at a head speed (HS) of 54 m/s are measured. The club used is a TOUR B XD-5 Driver/loft angle 8.5° (2017 model) manufactured by Bridgestone Sports Co., Ltd. and is evaluated according to the following rating criteria.

[Rating Criteria]

Good: Total compared with Comparative Example 1 is not more than −8.0 m, and at least −20.0 m.

Fair: Total compared with Comparative Example 1 is less than −20.0 m.

NG: Total compared with Comparative Example 1 is more than −8.0 m.

Evaluation of Flight (W #1, HS 45 m/s)

A driver is mounted on a golf swing robot, and a spin rate and a distance traveled (total) by a ball when struck at a head speed (HS) of 45 m/s are measured. The club used is a J015 Driver/loft angle 9.5° (2016 model) manufactured by Bridgestone Sports Co., Ltd. and is evaluated according to the following rating criteria.

[Rating Criteria]

Good: Total compared with Comparative Example 1 is at least −5.0 m.

Fair: Total compared with Comparative Example 1 is at least −10.0 m and less than −5.0 m.

NG: Total compared with Comparative Example 1 is less than −10.0 m.

Evaluation of Flight (W #1, HS 40 m/s)

A driver is mounted on a golf swing robot, and a spin rate and a distance traveled (total) by a ball when struck at a head speed (HS) of 40 m/s are measured. The club used is a J015 Driver/loft angle 9.5° (2016 model) manufactured by Bridgestone Sports Co., Ltd. and is evaluated according to the following rating criteria.

[Rating Criteria]

Good: Total compared with Comparative Example 1 is at least −5.0 m.

Fair: Total compared with Comparative Example 1 is at least −10.0 m and less than −5.0 m.

NG: Total compared with Comparative Example 1 is less than −10.0 m.

Evaluation of Flight (I #6, HS 42 m/s)

When a number six iron (I #6) is mounted on the golf swing robot and a ball is struck at an HS of 42 m/s, a spin rate and a distance traveled (total) are measured. In addition, the distance (total−carry) of only the run is obtained. The club used is a JGR Forged I #6 (2016 model) manufactured by Bridgestone Sports Co., Ltd. and is evaluated according to the following rating criteria.

[Assessment Criteria/Total]

Good: Total compared with Comparative Example 1 is at least 0 m.

Fair: Total compared with Comparative Example 1 is at least −5.0 m and less than 0 m.

NG: Total compared with Comparative Example 1 is less than −5.0 m.

[Criteria/Run]

Good: Run is not more than 6.0 m.

NG: Run is larger than 6.0 m.

Evaluation of Flight (I #6, HS 35 m/s)

When a number six iron (I #6) is mounted on the golf swing robot and a ball is struck at an HS of 35 m/s, a spin rate and a distance traveled (total) are measured. In addition, the distance (total−carry) of only the run is obtained. The club used is a JGR Forged I #6 (2016 model) manufactured by Bridgestone Sports Co., Ltd. and is evaluated according to the following rating criteria.

[Assessment Criteria/Total]

Good: Total compared with Comparative Example 1 is at least 0 m.

Fair: Total compared with Comparative Example 1 is at least −5.0 m and less than 0 m.

NG: Total compared with Comparative Example 1 is less than −5.0 m.

[Criteria/Run]

Good: Run is not more than 6.0 m.

NG: Run is larger than 6.0 m.

Evaluation of Spin Rate on Approach Shots

A judgment is made based on a spin rate when a sand wedge is mounted on the golf swing robot and a ball is struck at an HS of 15 m/s. Similarly, a spin rate immediately after the ball is struck is measured by a device for measuring initial conditions. The sand wedge used is a TOURSTAGE TW-03 (loft angle 57°) 2002 model manufactured by Bridgestone Sports Co., Ltd.

[Rating Criteria]

Good: Spin rate is at least 4.500 rpm

NG: Spin rate is less than 4.500 rpm

TABLE 9

| | | | Example | | | Comparative Example | | | |
|---|---|---|---|---|---|---|---|---|---|
| | | | 1 | 2 | 3 | 1 | 2 | 3 | 4 |
| Flight | W#1 | Spin rate (rpm) | 2,801 | 2,794 | 2,782 | 2,786 | 2,794 | 2,542 | 2,545 |
| | HS | Total (m) | 271.5 | 273.3 | 270.4 | 281.5 | 259.6 | 276.1 | 268.8 |
| | 54 m/s | Total (m) compared to Comparative Example 1 | −10.0 | −8.2 | −11.1 | 0.0 | −21.9 | −5.4 | −12.7 |

TABLE 9-continued

| | | | | | | | | | |
|---|---|---|---|---|---|---|---|---|---|
| | | Rating | Good | Good | Good | NG | Fair | NG | Good |
| | W#1 | Spin rate (rpm) | 2,912 | 2,901 | 2,894 | 2,890 | 2,901 | 2,774 | 2,776 |
| | HS | Total (m) | 230.4 | 231.0 | 226.7 | 236.3 | 223.8 | 233.9 | 222.4 |
| | 45 m/s | Total (m) compared to Comparative Example 1 | −5.9 | −5.3 | −9.6 | 0.0 | −12.5 | −2.4 | −13.9 |
| | | Rating | Fair | Fair | Fair | Good | NG | Good | NG |
| | W#1 | Spin rate (rpm) | 3,177 | 3,166 | 3,125 | 3,154 | 3,166 | 2,912 | 2,900 |
| | HS | Total (m) | 200.4 | 199.5 | 200.0 | 198.3 | 198.6 | 199.5 | 200.4 |
| | 40 m/s | Total (m) compared to Comparative Example 1 | 2.1 | 1.2 | 1.7 | 0.0 | 0.3 | 1.2 | 2.1 |
| | | Rating | Good | Good | Good | Good | Good | Good | Good |
| | I#6 | Spin rate (rpm) | 5,780 | 5,751 | 5,540 | 5,721 | 5,751 | 4,948 | 5,039 |
| | HS | Carry (m) | 175.6 | 175.3 | 177.5 | 173.2 | 173.5 | 177.9 | 179.9 |
| | 42 m/s | Total (m) | 180.6 | 181.3 | 183.4 | 178.1 | 177.2 | 184.4 | 186.6 |
| | | Total (m) compared to Comparative Example 1 | 2.5 | 3.2 | 5.3 | 0.0 | −0.9 | 6.3 | 8.5 |
| | | Rating | Good | Good | Good | Good | Fair | Good | Good |
| | | Run | 5.0 | 6.0 | 5.9 | 4.9 | 3.7 | 6.5 | 6.7 |
| | | Rating | Good | Good | Good | Good | Good | NG | NG |
| | I#6 | Spin rate (rpm) | 5,448 | 5,468 | 5,267 | 5,487 | 5,468 | 4,724 | 4,807 |
| | HS | Carry (m) | 135.9 | 135.7 | 136.4 | 134.6 | 137.3 | 137.8 | 139.2 |
| | 35 m/s | Total (m) | 141.9 | 139.8 | 140.1 | 140.1 | 142.3 | 144.7 | 146.0 |
| | | Total (m) compared to Comparative Example 1 | 1.8 | −0.3 | 0.0 | 0.0 | 2.2 | 4.6 | 5.9 |
| | | Rating | Good | Fair | Good | Good | Good | Good | Good |
| | | Run | 6.0 | 4.1 | 3.7 | 5.5 | 5.0 | 6.9 | 6.8 |
| | | Rating | Good | Good | Good | Good | Good | NG | NG |
| Approach | SW | Spin rate (rpm) | 5,161 | 5,145 | 5,050 | 5,128 | 5,145 | 5,087 | 5,139 |
| | HS | Rating | Good | Good | Good | Good | Good | Good | Good |
| | 15 m/s | | | | | | | | |
| Determination (score) | W#1 HS 54 m/s total | | 2 | 2 | 2 | 0 | 1 | 0 | 2 |
| | W#1 HS 45 m/s total | | 1 | 1 | 1 | 2 | 0 | 2 | 0 |
| | W#1 HS 40 m/s total | | 2 | 2 | 2 | 2 | 2 | 2 | 2 |
| | I#6 HS 42 m/s total | | 2 | 2 | 2 | 2 | 1 | 2 | 2 |
| | Ditto Run | | 2 | 2 | 2 | 2 | 2 | 0 | 0 |
| | I#6 HS 35 m/s total | | 2 | 1 | 2 | 2 | 2 | 2 | 2 |
| | Ditto Run | | 2 | 2 | 2 | 2 | 2 | 0 | 0 |
| | Approach HS 15 m/s spin performance | | 2 | 2 | 2 | 2 | 2 | 2 | 2 |
| | Total | | 15 | 14 | 15 | 14 | 12 | 10 | 10 |

| | | | | Comparative Example | | | | | |
|---|---|---|---|---|---|---|---|---|---|
| | | | | 5 | 6 | 7 | 8 | 9 | 10 |
| Flight | W#1 | Spin rate (rpm) | | 2,981 | 2,981 | 2,621 | 2,574 | 2,529 | 3,149 |
| | HS | Total (m) | | 269.3 | 259.7 | 269.6 | 271.0 | 266.3 | 259.8 |
| | 54 m/s | Total (m) compared to Comparative Example 1 | | −12.2 | −21.8 | −11.9 | −10.5 | −15.2 | −21.7 |
| | | Rating | | Good | NG | Good | Good | Good | Fair |
| | W#1 | Spin rate (rpm) | | 3,062 | 3,062 | 2,824 | 2,724 | 2,704 | 3,439 |
| | HS | Total (m) | | 220.6 | 215.1 | 222.8 | 224.0 | 222.0 | 210.1 |
| | 45 m/s | Total (m) compared to Comparative Example 1 | | −15.7 | −21.2 | −13.5 | −12.3 | −14.3 | −26.2 |
| | | Rating | | NG | NG | NG | NG | NG | NG |
| | W#1 | Spin rate (rpm) | | 3,372 | 3,372 | 3,009 | 2,906 | 2,850 | 3,629 |
| | HS | Total (m) | | 184.9 | 186.9 | 195.9 | 192.4 | 193.9 | 179.0 |
| | 40 m/s | Total (m) compared to Comparative Example 1 | | −13.4 | −11.4 | −2.4 | −5.9 | −4.4 | −19.3 |
| | | Rating | | NG | NG | Good | Fair | Good | NG |
| | I#6 | Spin rate (rpm) | | 6,249 | 6,249 | 5,213 | 5,088 | 4,944 | 6,354 |
| | HS | Carry (m) | | 159.1 | 161.3 | 171.2 | 170.8 | 171.4 | 162.1 |
| | 42 m/s | Total (m) | | 163.4 | 165.7 | 176.8 | 177.1 | 176.9 | 167.1 |
| | | Total (m) compared to Comparative Example 1 | | −14.7 | −12.4 | −1.3 | −1.0 | −1.2 | −11.0 |
| | | Rating | | NG | NG | Fair | Fair | Fair | NG |
| | | Run | | 4.3 | 4.4 | 5.6 | 6.3 | 5.5 | 5.0 |
| | | Rating | | Good | Good | Good | NG | Good | Good |
| | I#6 | Spin rate (rpm) | | 5,881 | 5,881 | 5,051 | 4,805 | 4,751 | 6,067 |
| | HS | Carry (m) | | 122.5 | 123.7 | 131.6 | 131.4 | 132.4 | 123.7 |
| | 35 m/s | Total (m) | | 129.8 | 131.5 | 138.6 | 137.4 | 139.6 | 131.1 |
| | | Total (m) compared to Comparative Example 1 | | −10.3 | −8.6 | −1.5 | −2.7 | −0.5 | −9.0 |
| | | Rating | | NG | NG | Fair | Fair | Fair | NG |
| | | Run | | 7.3 | 7.8 | 7.0 | 6.0 | 7.2 | 7.4 |
| | | Rating | | NG | NG | NG | Good | NG | NG |
| Approach | SW | Spin rate (rpm) | | 5,162 | 5,162 | 5,088 | 5,116 | 5,079 | 5,079 |
| | HS | Rating | | Good | Good | Good | Good | Good | Good |
| | 15 m/s | | | | | | | | |

TABLE 9-continued

| | | | | | | | |
|---|---|---|---|---|---|---|---|
| Determination (score) | W#1 HS 54 m/s total | 2 | 0 | 2 | 2 | 2 | 1 |
| | W#1 HS 45 m/s total | 0 | 0 | 0 | 0 | 0 | 0 |
| | W#1 HS 40 m/s total | 0 | 0 | 2 | 1 | 2 | 0 |
| | I#6 HS 42 m/s total | 0 | 0 | 1 | 1 | 1 | 0 |
| | Ditto Run | 2 | 2 | 2 | 0 | 2 | 2 |
| | I#6 HS 35 m/s total | 0 | 0 | 1 | 1 | 1 | 0 |
| | Ditto Run | 0 | 0 | 0 | 2 | 0 | 0 |
| | Approach HS 15 m/s spin performance | 2 | 2 | 2 | 2 | 2 | 2 |
| | Total | 6 | 4 | 10 | 9 | 10 | 5 |

*The score is counted with Good as 2 points, Fair as 1 point, and NG as 0 point.

As shown in the results in Table 9, the golf balls of Comparative Examples 1 to 10 are inferior in the following respects to the golf balls according to the present invention (Examples).

Comparative Example 1 is one embodiment of a tour ball currently used by professionals or advanced players, and the value A1 is larger than 0.655. As a result, the distance on shots with a driver (W #1) at a head speed (HS) of 54 m/s excessively increases.

In Comparative Example 2, the value A1 is smaller than 0.590, and the value of (A2+A3)/2 is smaller than 0.670. As a result, the distance on shots with a driver (W #1) at a head speed (HS) of 54 m/s is excessively reduced, and the distance on shots with a driver (W #1) at a head speed (HS) of 45 m/s is inferior.

In Comparative Example 3, the value A1 is larger than 0.655, the deflection of the ball under a predetermined load is larger than 2.7 mm, and the value of Ciw+Miw+CViw is smaller than 2,600. As a result, the distance on shots with a driver (W #1) at a head speed (HS) of 54 m/s excessively increases, and the run on shots with a number six iron (I #6) becomes large.

In Comparative Example 4, the deflection of the ball under a predetermined load is larger than 2.7 mm, and the value of Ciw+Miw+CViw is smaller than 2.600. As a result, the distance on shots with a driver (W #1) at a head speed (HS) of 45 m/s is inferior, and the run on shots with a number six iron (I #6) becomes large.

In Comparative Example 5, the value A1 is larger than 0.655, the initial velocity of the ball is smaller than 76.5 m/s, and Ciw+Miw+CViw is smaller than 2,600. As a result, the distances on shots with a driver (W #1) at head speeds (HS) of 45 m/s and 40 m/s are inferior, and the run on shots with a number six iron (I #6) is reduced.

In Comparative Example 6, the initial velocity of the ball is smaller than 76.5 m/s, and Ciw+Miw+CViw is smaller than 2,600. As a result, the distance on shots with a driver (W #1) at a head speed (HS) of 54 m/s is excessively reduced, the distances on shots with a driver (W #1) at head speeds (HS) of 45 m/s and 40 m/s are reduced, and the run on shots with a number six iron (I #6) is inferior.

In Comparative Example 7, the value A1 is larger than 0.655, the deflection of the ball under a predetermined load is larger than 2.7 mm, the initial velocity of the ball is smaller than 76.5 m/s, and Ciw+Miw+CViw is smaller than 2,600. As a result, the distance on shots with a driver (W #1) at a head speed (HS) of 45 m/s is inferior, and the run on shots with a number six iron (I #6) at a head speed (HS) of 35 m/s becomes large.

In Comparative Example 8, the value A1 is larger than 0.655, the deflection of the ball under a predetermined load is larger than 2.7 mm, the initial velocity of the ball is smaller than 76.5 m/s, and Ciw+Miw+CViw is smaller than 2,600. As a result, the distances on shots with a driver (W #1) at a head speed (HS) of 45 m/s and with a number six iron (I #6) at a head speed (HS) of 40 m/s are inferior, and the run on shots with a number six iron (I #6) at a head speed (HS) of 42 m/s becomes large.

In Comparative Example 9, the value A1 is larger than 0.655, the deflection of the ball under a predetermined load is larger than 2.7 mm, the initial velocity of the ball is smaller than 76.5 m/s, and Ciw+Miw+CViw is smaller than 2,600. As a result, the distances on shots with a driver (W #1) at a head speed (HS) of 45 m/s and with a number six iron (I #6) are inferior, and the run on shots with a number six iron (I #6) at a head speed (HS) of 35 m/s becomes large.

Comparative Example 10 corresponds to a practice golf ball having a two-piece structure for a driving range, in which the initial velocity of the ball is smaller than 76.5 m/s, and Ciw+Miw+CViw is larger than 2,715. As a result, the distance on shots with a driver (W #1) at a head speed (HS) of 54 m/s is excessively reduced, the distances on shots with a driver (W #1) at head speeds (HS) of 45 m/s and 40 m/s with a number six iron (I #6) are inferior.

Japanese Patent Application No. 2022-190894 is incorporated herein by reference. Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an intermediate layer, and a cover, wherein a large number of dimples are formed on an outer surface of the cover, and a relationship between a surface hardness of an intermediate layer-encased sphere and a surface hardness of the ball satisfies the following condition:

(surface hardness of ball)<(surface hardness of intermediate layer-encased sphere)

[where the surface hardnesses mean Shore C hardnesses], and when an initial velocity of the ball is 76.5 to 77.724 m/s and a deflection is less than 2.7 mm when the ball is compressed under a final load of 1,275 N (130 kgf) from an initial load of 98 N (10 kgf), a value of (initial velocity of core×weight of core) is denoted by Ciw, a value of [(initial velocity of intermediate layer-encased sphere−initial velocity of core)×(weight of intermediate layer-encased sphere−weight of core)] is denoted by Miw, and a value of [(initial velocity of ball−initial velocity of intermediate layer-encased sphere)×(weight of ball−weight of intermediate layer-encased sphere)] is denoted by CViw, the following condition is satisfied:

$2{,}600 \leq Ciw+Miw+CViw \leq 2{,}715$, and when a ratio CL1/CD1 of a lift coefficient CL1 at a Reynolds number of 218000 and a spin rate of 2800 rpm to a drag coefficient CD1 is denoted by A1, a ratio CL2/CD2 of a lift coefficient CL2 at a Reynolds number of 184000 and a spin rate of 2900 rpm to a drag coefficient CD2 is denoted by A2, and a ratio CL3/CD3 of a lift coefficient CL3 at a Reynolds number of 158000 and a spin rate of 3100 rpm to a drag coefficient CD3 is denoted by A3, the following two conditions are satisfied:

$$0.590 \leq A1 \leq 0.655 \text{ and}$$

$$(A2+A3)/2 \geq 0.670.$$

2. The multi-piece solid golf ball according to claim 1, wherein a volume occupancy ratio VR of the dimples is 0.77 to 0.92%.

3. The multi-piece solid golf ball according to claim 1, wherein the value of (A2+A3)/2 is 0.670 to 0.783.

4. The multi-piece solid golf ball according to claim 1, wherein the value of A2 is 0.635 to 0.750, and the value of A3 is 0.695 to 0.815.

5. The multi-piece solid golf ball according to claim 1, wherein a relationship between a surface hardness of the core and the surface hardness of the intermediate layer-encased sphere satisfies the following condition:

(surface hardness of intermediate layer-encased sphere)≥(surface hardness of core)

(where the surface hardnesses mean Shore C hardnesses).

6. The multi-piece solid golf ball according to claim 1, wherein when the initial velocity of the core is denoted by Vc (m/s), and a deflection is denoted by C (mm) when the core is compressed under a final load of 1,275 N (130 kgf) from an initial load of 98 N (10 kgf), the following condition is satisfied:

$$20 \leq Vc/C \leq 30.$$

7. The multi-piece solid golf ball according to claim 1, wherein when each sphere of the core, the intermediate layer-encased sphere, and the ball is compressed under a final load of 1,275 N (130 kgf) from an initial load of 98 N (10 kgf) and the deflections (mm) are denoted by C (mm), M (mm), and B (mm) respectively, the following two conditions are satisfied:

$$0.30 \leq C-B \leq 0.90$$

$$0.30 \leq C-M \leq 0.65.$$

8. The multi-piece solid golf ball according to claim 1, wherein when the core is compressed under a final load of 1,275 N (130 kgf) from an initial load of 98 N (10 kgf) and the deflection (mm) is denoted by C (mm), the following condition is satisfied:

$$700 \leq Ciw/C \leq 1000.$$

9. The multi-piece solid golf ball according to claim 1, wherein the core has a hardness profile in which, letting the Shore C hardness at a core center be Cc, the Shore C hardness at a midpoint M between the core center and a core surface be $C_m$, the Shore C hardnesses at positions 2 mm, 4 mm, and 6 mm inward from the midpoint M be Cm−2, Cm−4, and Cm−6 respectively, the Shore C hardnesses at positions 2 mm, 4 mm, and 6 mm outward from the midpoint M be Cm+2, Cm+4, and Cm+6 respectively, and the Shore C hardness at the core surface be Cs, and defining surface areas A to F as follows:

surface area $A$: $\frac{1}{2} \times 2 \times (Cm-4-Cm-6)$ surface area $B$: $\frac{1}{2} \times 2 \times (Cm-2-Cm-4)$ surface area $C$: $\frac{1}{2} \times 2 \times (Cm-Cm-2)$ surface area $D$: $\frac{1}{2} \times 2 \times (Cm+2-Cm)$ surface area $E$: $\frac{1}{2} \times 2 \times (Cm+4-Cm+2)$ surface area $F$: $\frac{1}{2} \times 2 \times (Cm+6-Cm+4)$ the following condition is satisfied:

{(surface area $D$+surface area $E$)−(surface area $A$+surface area $B$)}≥4.0.

10. The multi-piece solid golf ball according to claim 9, wherein the core has a hardness profile in which the following condition is satisfied:

$$(Cs-Cc) \geq 22.$$

11. The multi-piece solid golf ball according to claim 9, wherein the core has a hardness profile in which the following condition is satisfied:

$$(Cs-Cc)/(Cm-Cc) \geq 4.0.$$

12. The multi-piece solid golf ball according to claim 9, wherein the core has a hardness profile in which the following condition is satisfied:

surface area $E$>surface area $D$>surface area $C$.

* * * * *